US007651142B2

(12) United States Patent
Kirnak

(10) Patent No.: US 7,651,142 B2
(45) Date of Patent: Jan. 26, 2010

(54) AUTOMATIC RELEASE ATTACHMENT FOR KITES AND THE LIKE, AND METHOD OF USE

(75) Inventor: Michael W. Kirnak, 2512 NW. 37th Ave., Camas, WA (US) 98607

(73) Assignee: Michael W. Kirnak, Camas, WA (US)

( * ) Notice: Subject to any disclaimer, the term of this patent is extended or adjusted under 35 U.S.C. 154(b) by 0 days.

(21) Appl. No.: 12/351,981

(22) Filed: Jan. 12, 2009

(65) Prior Publication Data

US 2009/0121086 A1 May 14, 2009

Related U.S. Application Data

(62) Division of application No. 11/557,371, filed on Nov. 7, 2006.

(51) Int. Cl.
*B66C 1/36* (2006.01)
*B64D 17/38* (2006.01)

(52) U.S. Cl. ..... 294/82.24; 294/82.17; 294/82.25; 244/155 A

(58) Field of Classification Search ..... 294/82.25, 294/82.17, 82.19, 82.24, 82.31, 155 A, 155 R; 24/373, 375
See application file for complete search history.

(56) References Cited

U.S. PATENT DOCUMENTS 2,357,478 A * 9/1944 Koch ..... 24/600.9
2,992,465 A * 7/1961 Gale ..... 294/82.14
3,782,772 A * 1/1974 Cranston et al. ..... 294/81.56
4,062,581 A * 12/1977 Munscher ..... 294/82.25

* cited by examiner

*Primary Examiner*—Dean J Kramer
(74) *Attorney, Agent, or Firm*—Norris McLaughlin & Marcus, P.A.

(57) ABSTRACT

An automatic release attachment automatically releases a tension line engaged to the attachment when the tension in the line exceeds the tension rating corresponding to a tension release settings selected by an operator. A hook assembly, which can be part of the attachment, includes a shackle that eases shackling and unshackling of a coupling element of the tension line to the hook assembly.

4 Claims, 23 Drawing Sheets

AUTOMATIC RELEASE ATTACHMENT FOR KITES AND THE LIKE, AND METHOD OF USE

CROSS REFERENCE TO RELATED APPLICATIONS

This application claims the benefit of U.S. Provisional Application Nos. 60/741,797 filed Dec. 2, 2005 and 60/734,569 filed Nov. 8, 2005, incorporated by reference herein.

FIELD OF THE INVENTION

The present invention relates generally to attaching a line from a power or traction kite to the harness of an operator of the kite and, more particularly, an attachment for a termination or other portion of a line extending from a power or traction kite which provides for automatic release of the line at several user-selectable tension release settings.

BACKGROUND OF THE INVENTION

Large kites are used to provide motive force for several sports, most notably kite-boarding and snow-kiting. For example, a rider on a wakeboard-style board, a surfboard, a snowboard, skis or the like can be towed by a kite. Both kite-boarding and snow-kiting involve jumping, where the kite lifts the rider and the board to which the rider usually is coupled, such as by a foot loop, off the surface over which the board had been moving, thereby causing the rider to glide for a distance in a manner similar to a paraglider.

A front control line extending from a leading edge of a kite terminates in what is commonly known as a trim loop or chicken loop. The chicken loop is hooked onto a hook affixed to a spreader bar that is strapped to a harness worn by an operator of a kite, such as the rider of a surfboard being towed by a kite. After the chicken loop is engaged to the hook of the spreader bar, the chicken loop can then be manually locked in place, or shackled.

In addition, rear control lines extending from the trailing edge of the kite are attached to the two ends of a control bar. The operator of the kite uses the control bar to control the kite's flight. For example, when the operator pulls the control bar inwardly toward his body, the length of the rear control lines is effectively reduced, which rotates the kite so that the angle of attack is increased. When tension on the control bar is released, the control bar moves outwardly, away from the operator, effectively lengthening the rear control lines. This lengthening rotates the kite to a position with a lower angle of attack, decreasing the kite's lift. To turn the kite, the operator pulls inwardly only on one end of the control bar, which twists the kite in such a manner that it turns.

Most spreader bars have a simple, U-shaped hook extending therefrom and to which the chicken loop can be attached. In the prior art, the chicken loop is secured to the spreader bar usually by manually inserting a length of plastic tubing, which is attached to one end of the chicken loop, into the space between the two sides of the hook. This securing technique is slow and ungainly both for shackling and unshackling the chicken loop and, therefore, not favored.

In another prior art chicken loop securing technique, a piece of plastic is rotated under a hook extending from the spreader bar. The plastic is snapped into the middle of the hook, locking the chicken loop in place.

Still other spreader bar designs include a manual release utilizing a rotating hook extending from the spreader bar. Such spreader bars include a movable bar, lever or like device positioned in front of the lower part of the hook for preventing rotation of the hook. To release the chicken loop, the bar is moved so that it no longer restrains rotation of the hook. This type of kite release is not a fail safe design, and also has other disadvantages. If the hinge on which the bar rotates fails, the bar can actually be pulled into the middle of the hook as the hook rotates, which effectively locks the chicken loop in place. Similarly, other known chicken loop manual safety releases rely on releasing one side of the chicken loop, thereby allowing the loop to slide through the spreader bar hook. If the release hinge were to fail, the chicken loop would be prevented from sliding through the hook, such that the operator of the kite could not disconnect himself from the kite.

Overall, currently known spreader bar designs rely on an operator removing one hand from the control bar to shackle or unshackle the chicken loop, respectively, to and from the hook and, furthermore, manually activating any available safety release. Recognition of a dangerous situation by a kite operator takes time, and it also takes time for the kite operator to reach for and activate a manual safety release. It has been found that combined human recognition and reaction time is so long that, in many circumstances, the operator cannot act quickly enough to activate a manual safety release before a dangerous situation occurs. Further, in practice, it is difficult for an operator, such as a rider of kite-board, to fly a powerful kite with one hand while manipulating current shackle systems with the other hand to release the kite line.

Also, it is known that most riders, by force of habit, will initially attempt to control a kite when the kite acts unexpectedly, instead of attempting to release the kite. All too often, by the time the rider decides to take steps to release the kite, it is too late to avoid the dangerous situation, which can result in serious injury or death to the rider. For example, an unexpected gust of wind or a kite-control malfunction can cause loftings, which are unintentional flights caused by a kite lifting the rider, and draggings, where a kite drags the rider. Oftentimes, once a rider is being dragged, the rider may not be able to take the necessary physical actions to activate a manual safety release.

Therefore, there is need for an attachment for a tension line, such as a termination of a kite line, which can be releasably engaged to a coupling element of the line and automatically releases the engaged tension line as a function of a tension release setting selected by the operator and, furthermore, makes shackling and unshackling of the coupling element of the line, respectively, to and from a hook easy and convenient.

SUMMARY OF THE INVENTION

In accordance with the present invention, an automatic release attachment for releasably engaging a coupling element of a tension line, such as a chicken loop termination of a kite line, provides for quick and automatic release of the coupling element when the tension in the line exceeds the tension rating corresponding to a selected one of plurality of user-selectable tension release settings.

In a preferred embodiment, the attachment is fixed to a spreader bar that is secured to a harness strapped to an individual, and includes a hook assembly secured to a shaft and which is for engaging a termination of a tension line. A rotatable release ring is disposed on the shaft between the hook assembly and a resilient element, which is also coupled to the shaft, and is rotatable about the shaft to a plurality of tension release settings. The hook assembly is movable between open and closed positions where the hook assembly is, respectively, disengaged from and engaged with the ring.

The ring is rotatable to positions respectively corresponding to the plurality of tension settings at which the hook assembly, when in the closed position, can be engaged with the ring. The resilient element maintains the hook assembly engaged to the ring at a selected tension setting, so long as the tension on the line does not exceed the tension rating for the selected setting. When the tension on the line exceeds the tension rating for the selected setting, the hook assembly automatically is released from the ring, which in turn provides for release of the termination of the tension from the hook assembly.

In a further preferred embodiment, a hook assembly, which can be part of the attachment or fixed directly to a spreader bar, includes a flexible shackle that makes shackling and unshackling of a termination, such as a chicken loop, respectively, to and from the hook assembly, and thus the attachment, easy and convenient for an operator of the kite, such as a rider of a board being towed by the kite.

In another preferred embodiment of the invention, a hook assembly includes a retaining bar that prevents a chicken loop from becoming unshackled when the chicken loop is moving towards a rearward portion of an interior region of the hook assembly in which the chicken loop, when engaged to the hook assembly, is retained, unless a downward force is applied to the chicken loop during such rearward movement. In still a further preferred embodiment, the hook assembly with the retaining bar, and with or without a flexible shackle, is attached directly to a spreader bar.

BRIEF DESCRIPTION OF THE DRAWINGS

Other objects and advantages of the present invention will be apparent from the following detailed description of the presently preferred embodiments, which description should be considered in conjunction with the accompanying drawings in which like references indicate similar elements and in which.

DETAILED DESCRIPTION OF THE INVENTION

For purposes of highlighting the features of the present invention, an automatic release attachment providing quick and automatic release of a termination of a tension line is described in detail below in connection with use of the release attachment in conjunction with a spreader bar which would be attached to a harness strapped to an individual operating a kite who desires to releasably secure the termination of a front control line of the kite to the release attachment. It is to be understood that the inventive of features of the automatic release attachment are readily applicable to other applications where easy engagement and disengagement of a coupling element of a line, rope, cord or the like, respectively, to and from an attachment are desired and where the attachment automatically releases the engaged termination when the tension on the line, rope, cord or the like exceeds the tension rating of a user-selected tension release setting that is desirable from a standpoint of safety or convenience.

Figure 1:
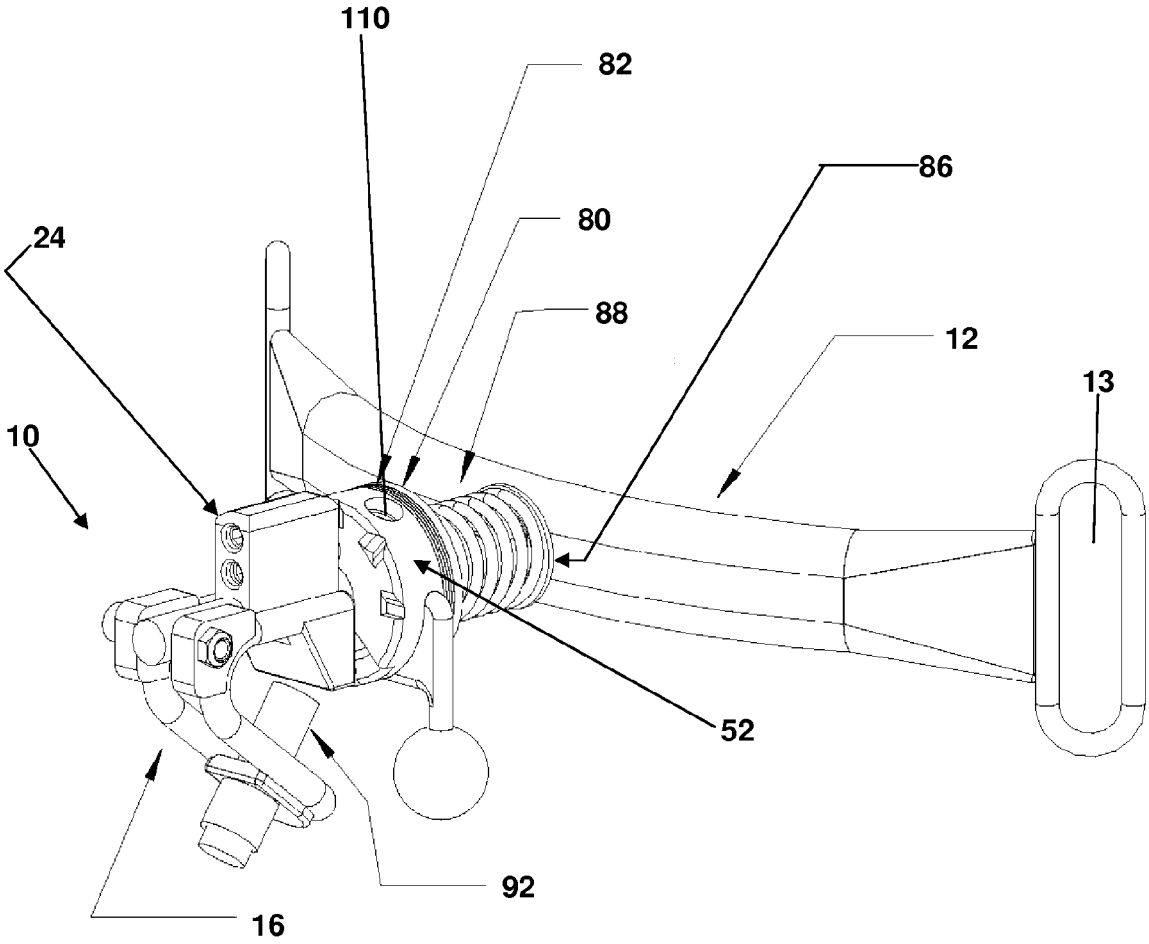
FIG. 1 is a perspective view of an embodiment of an automatic release attachment, in accordance with the present invention, coupled to a spreader bar and with a hook assembly in the closed position.

FIG. 1 illustrates an exemplary embodiment of an automatic release attachment 10, in accordance with the present invention, coupled to a spreader bar 12. Referring to FIG. 1, and to FIG. 3 which shows an exploded view of the attachment 10, the attachment 10 includes a main, cylindrically shaped shaft 14 secured at an end 21 to the spreader bar 12. The shaft 14 extends perpendicularly away from the bar 12 and has a hook assembly 16 secured at its other end 13. In FIG. 1, the hook assembly 16 is shown in the closed position, coupled to a release ring 52.

Figure 4:
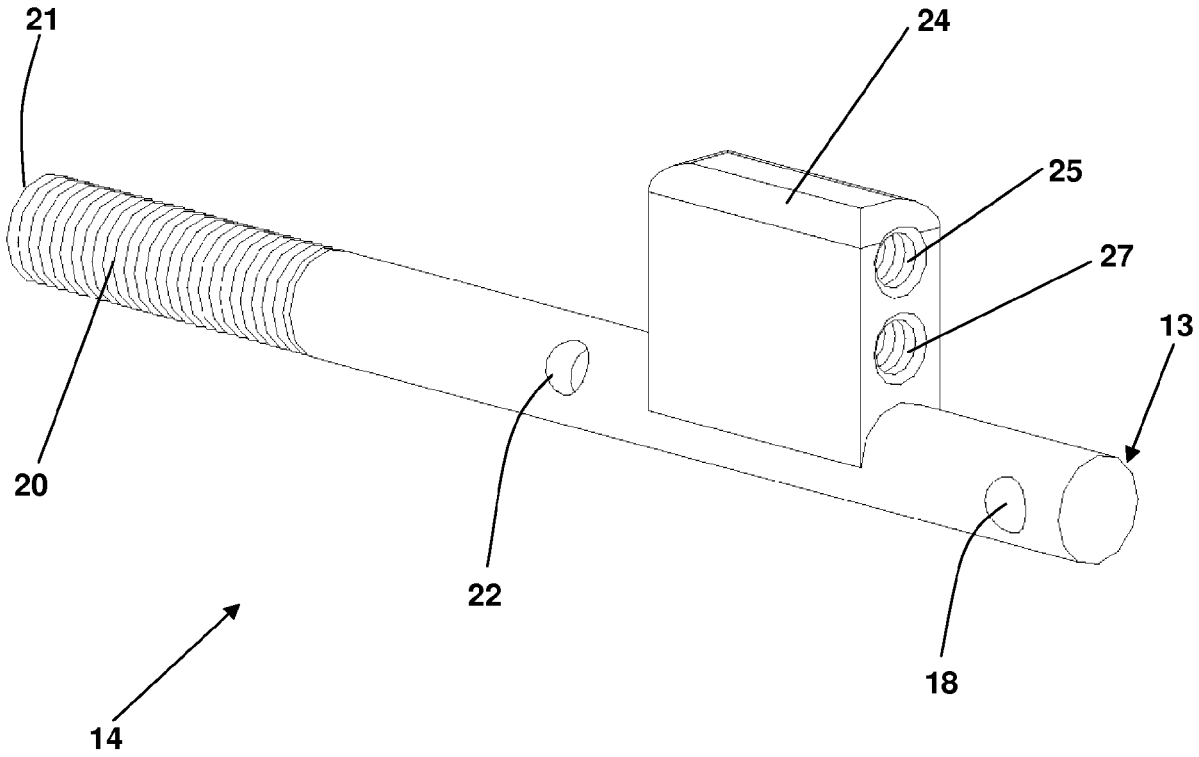
FIG. 4 is a perspective view of the main shaft of the release attachment of FIG. 1.

Further referring to FIG. 4, which illustrates an exemplary embodiment of the shaft 14, the shaft 14 includes an aperture 18 adjacent the end 13 and extending transversely through the shaft 14, and a threaded portion 20 extending from the end 21. The shaft 14 also includes an aperture 22 disposed intermediate the end 13 and the threaded portion 20 and extending transversely through the shaft 14. A limiter boss 24 is secured to the outer surface of the shaft 14 intermediate the apertures 18 and 22. The boss 24 includes threaded apertures 25, 27 extending in the same axial direction as the shaft 14 and disposed one on top of the other, with the aperture 27 being closest to the shaft 14.

Figure 3:
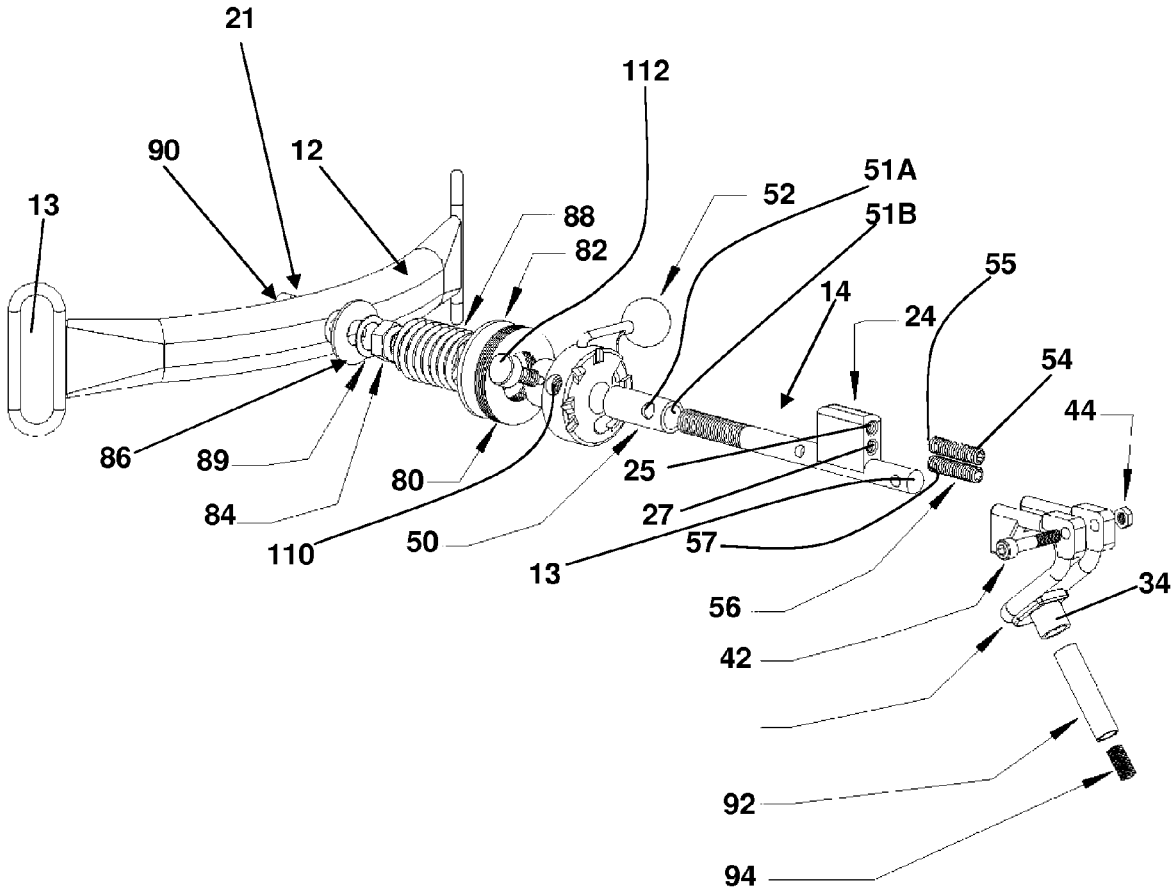
FIG. 3 is an exploded view of the release attachment of FIG. 1 shown in relation to the spreader bar.
Figure 5A:
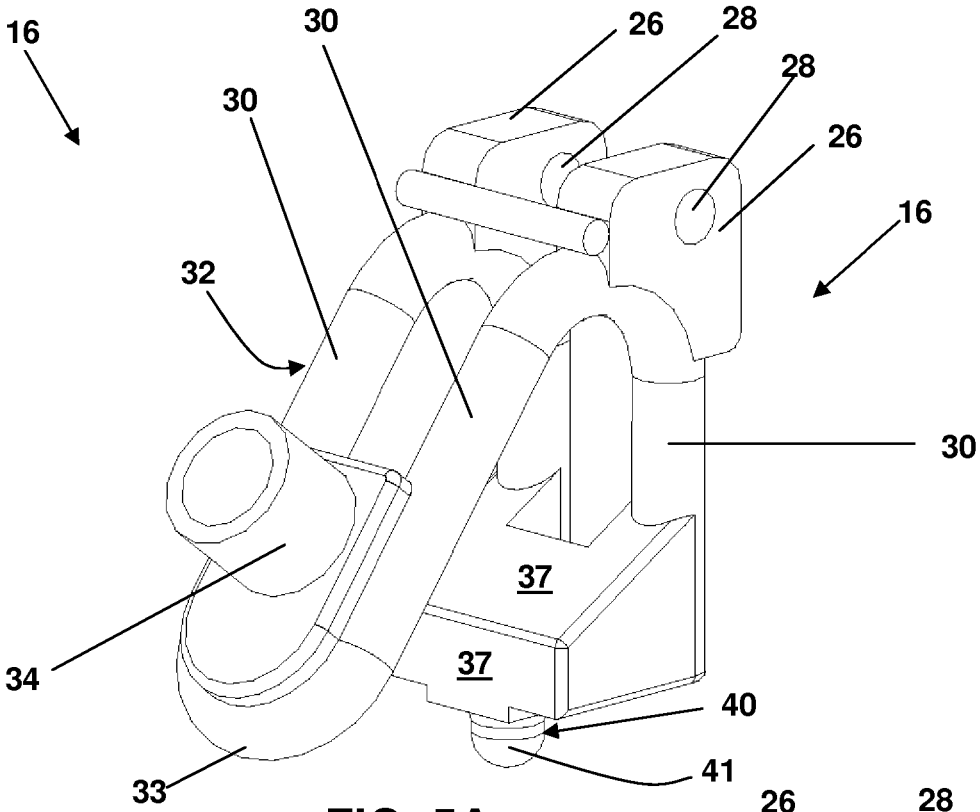
FIG. 5A is a perspective view of the hook assembly of the release attachment of FIG. 1.
Figure 5B:
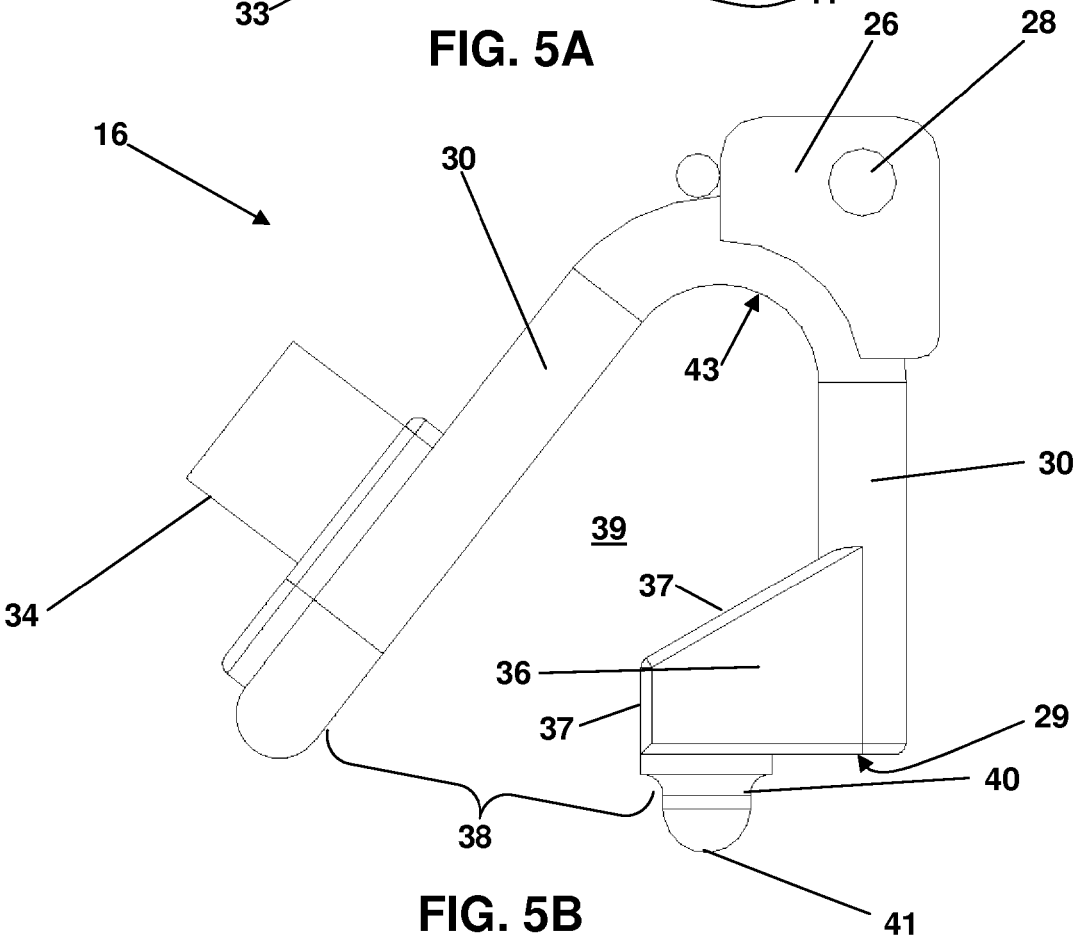
FIG. 5B is a side, isometric view of the hook assembly of the release attachment of FIG. 1.

Referring to FIGS. 1 and 3, and also to FIGS. 5A and 5B which show perspective and side isometric views, respectively, of the hook assembly 16, the hook assembly 16 includes opposing hinge plates 26 fixed to legs or pin brackets 30 of a folded, U-shaped bracket or hook 32. The hook 32 defines a region 39 for receiving a coupling element attached to a kite line, such as a termination of the line that is in the form of a chicken loop as is conventional in the art. The region 39 is defined by an opening 38, the brackets 30 and a stop 36. The U-shaped fold 43 of the brackets 30 is opposite the opening 38. Each of the opposing plates 26 includes an aperture 28 and the apertures 28 are axially aligned with each other. A shackle holder 34 is coupled at closed end 33 of the hook 32. The stop 36 is coupled to open end 29 of the hook 32, extends into the region 39, defines a portion of the opening 38 and has surfaces 37 facing the region 39. A release pin 40 having a semi-spherically-shaped tip 41 with a predetermined radius and curvature extends from the stop 36 in the direction opposite to the fold 43 of the hook 32. In a preferred embodiment, the components 26, 32, 34, 36 and 40 of the hook assembly 16 constitute an integral assembly. Alternatively, the components 26, 32, 34, 36 and 40 are formed by bending of wire or rod stock.

Referring again to FIGS. 1, 3 and 4, a hinge bolt 42 passing through the apertures 28 of the hook assembly 16 and the aperture 18 of the shaft 14, and onto which a nut 44 is threaded, pivotally secures the hook assembly 16 to the shaft 14. In alternative embodiments, the bolt 44 is a pin welded or clipped to the shaft 14 for pivotally securing the hook assembly 16 to the shaft 14.

Figure 6:
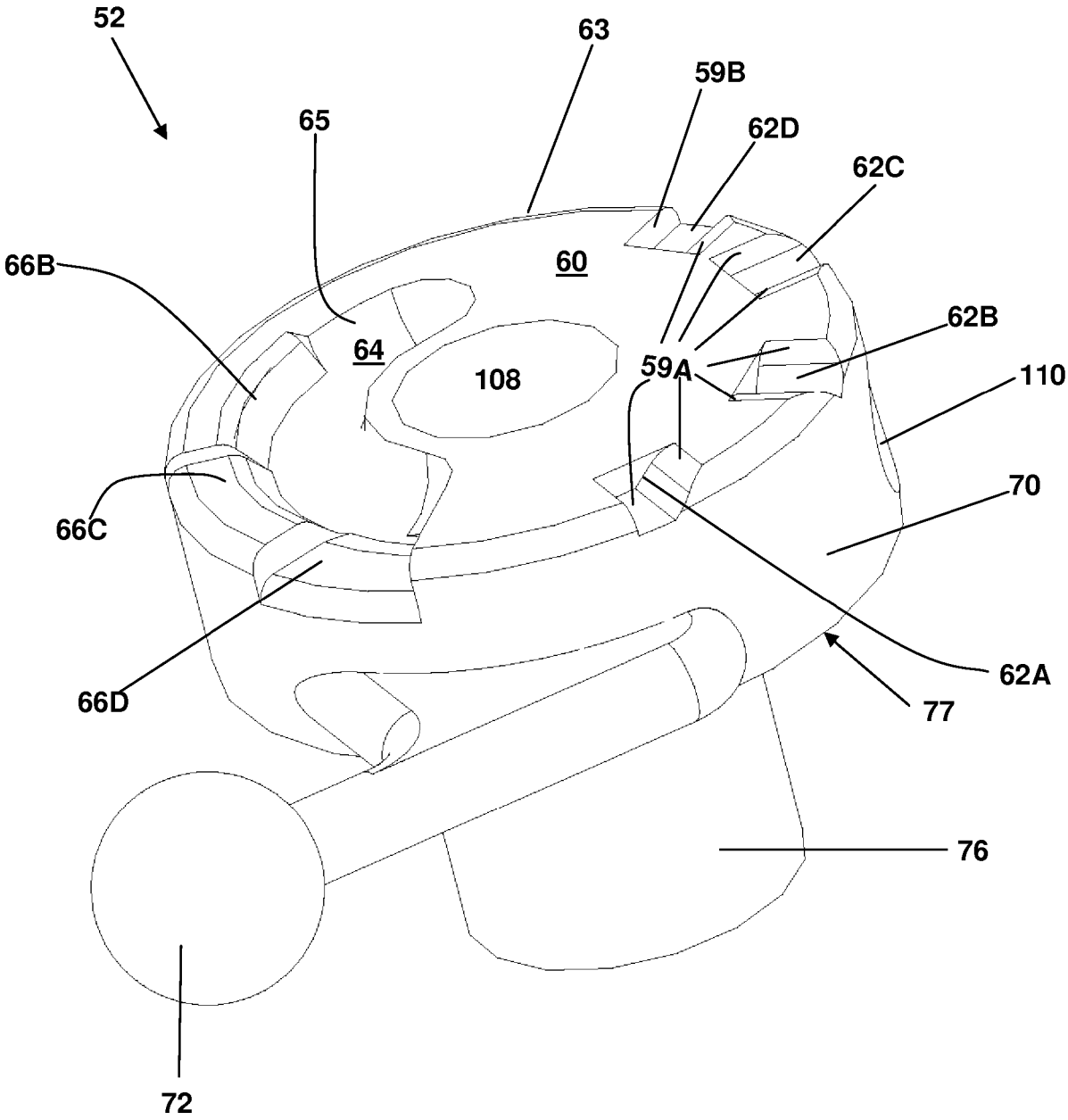
FIG. 6 is a perspective view of the release ring of the release attachment of FIG. 1.

Referring to FIGS. 1, 3 and 6, a cylindrical bearing 50, which encircles the shaft 14, is disposed on the shaft 14 adjacent to the limiter boss 24 and on the side of the boss 24 opposite to the hook assembly 16. The bearing 50 includes an aperture 51A extending radially between its outer surface and a central aperture 51B of the bearing. A spring plunger 54 is threaded through the aperture 25 of the boss 24, and a limiter set screw 56 is threaded through the aperture 27 of the boss 24. As discussed in detail below, the screws 54 and 56 are disposed within the apertures 25 and 27 so that respective ends 55 and are slightly above the opposing, top surface 60 of the ring 52, and where the end 55 of the screw 54 is disposed slightly closer to the surface 60 of the ring 52 than the end 57 of the screw 56.

Referring to FIG. 6, the release ring 52 includes a cylindrically-shaped body 70 having the top surface 60, which opposes the limiter boss 24, and a bottom surface 77. The body 70 defines an axially extending center aperture 108 and an aperture 110 extending radially away from the aperture 108 to the outer surface of the body 70. The bearing 50 is press fit within the aperture 108 of the ring 52 with the aperture 51A of the bearing 50 aligned with the aperture 110 of the ring 52. The release ring 52 further includes grooves 62A, 62B, 62C and 62D in the surface 60, spaced from each other and extending circumferentially along outer edge 63 of the surface 60. In addition, the surface 60 includes an annularly extending groove 64, spaced from the outer edge 63, having the same radius and curvature as the tip 41 of the release pin 40, a depth equal to the radius of the tip 41 and a wall surface 65 adjacent the edge 63. The surface 60 of the ring 52 further defines cut-away portions 66B, 66C and 66D disposed adjacent to each other, and extending annularly along the surface 60 adjacent to and radially outward of the groove 64.

Figure 16A:
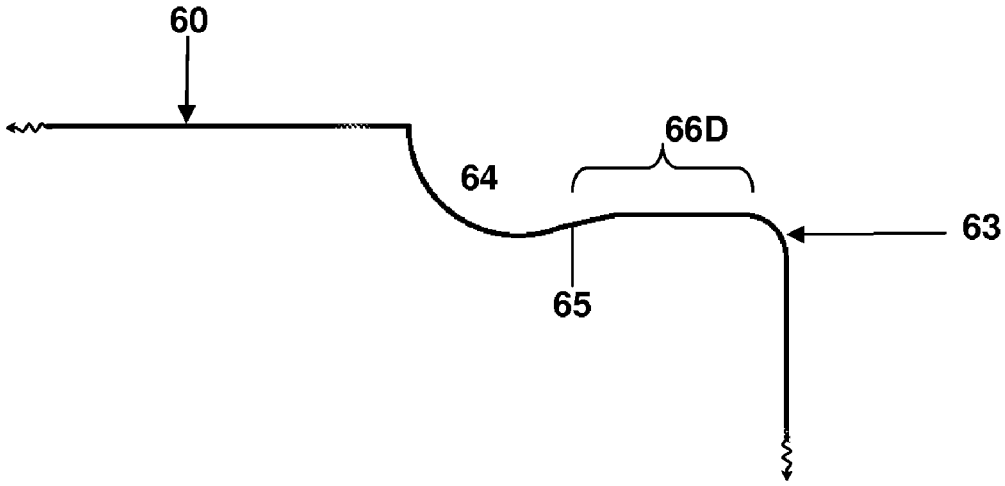
FIGS. 16A, 16B and 16C are isometric views of the cut-away portions of the release ring of FIG. 6 corresponding respectively to the release, low and medium settings for the attachment of FIG. 1A.
Figure 16B:
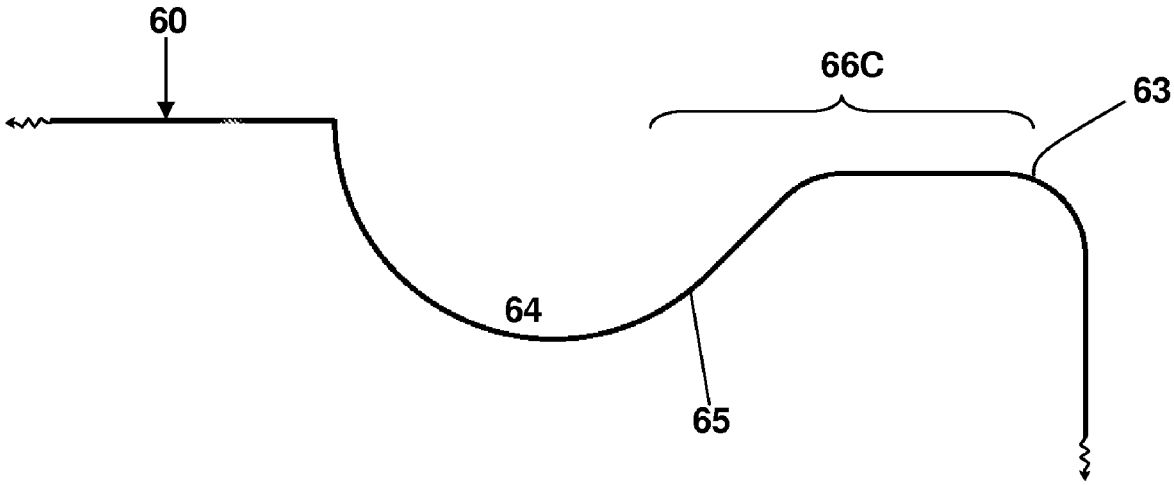
Figure 16C:
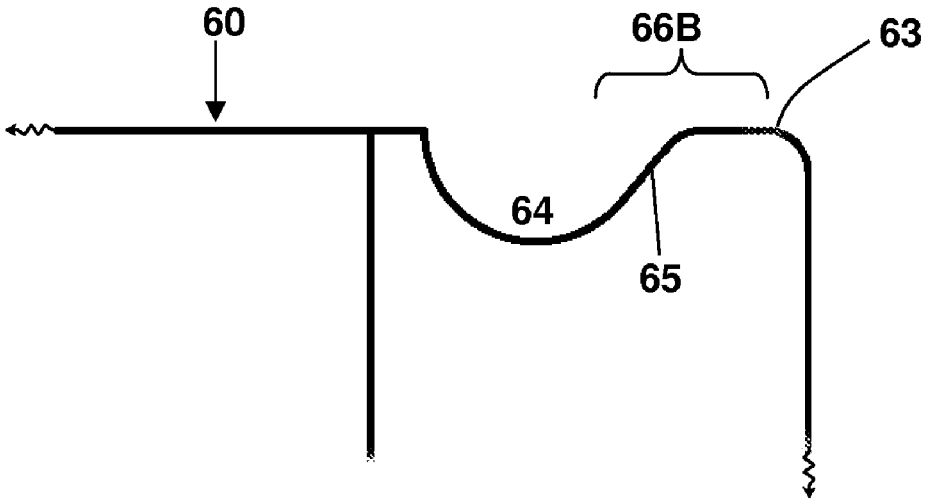
Figure 16D:
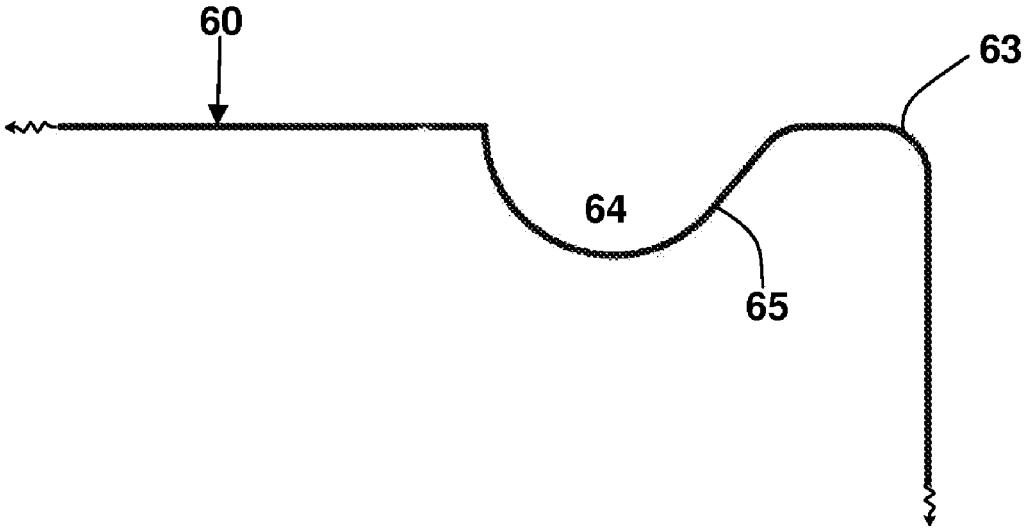
FIG. 16D is an isometric view of the portion of the groove of the release ring of FIG. 6 not adjacent to a cut-away portion.

In a preferred embodiment, the cut-away portions 66B, 66C and 66D are cut-outs in the surface 60 having gradually increasing depths, for example, about 0.8 mm, about 1.0 mm and about 1.2 mm. Alternatively, one or more of the cut-away portions 66B, 66C and 66D constitute bevels in the wall surface 65 of the groove 64, and each of the bevels is at a different angle in relation to the surface 60. In a preferred embodiment, one or more of the cut-away portions 66B, 66C and 66D include a cut-out with a bevel in the wall surface 65. FIGS. 16A, 16B and 16C show profile views of the cut-away portions 66D, 66C and 66B, respectively, which are defined in the surface 60 of the ring 52 adjacent the groove 64, and FIG. 16D shows a profile view of the surface 60 at the portion of the groove 64 that does not have an adjacent cut-away portion.

A handle 72 is secured to the body 70 of the release ring 52, and the ring 52 includes a cylindrically-shaped barrel 76, which has a smaller diameter than the body 70 and extends away from the bottom surface 77 of the body 70. In a preferred embodiment, the combined axial length of the barrel 76 and the body 70 of the ring 52 is at least about three times the diameter of the shaft 14 and the bearing 50 is a low friction bearing. If the ratio of the combined axial lengths to the shaft 14 diameter is too low, the bearing 50, which is press fit within the aperture 108 of the ring 52, may lock up against the shaft 14, which would substantially prevent axial movement of the ring 52 and also possibly inhibit rotational movement of the ring 52. In a most preferred embodiment, the combined axial length should be about at least 5 times the diameter of the shaft 14.

Referring to FIGS. 1 and 3, one or more shims 80 optionally are disposed on the barrel 76 of the release ring 52 intermediate the surface 77 and a spring washer 82, the washer 82 also being disposed on the barrel 76. A limiter nut 84 is disposed at the portion of the threaded portion 20 of the shaft 14 that is furthest away from the end 21. A resilient element 88, which is in the illustrated embodiment is a spring 88 that encircles the shaft 14, the limiter nut 84 and an optional washer 89 disposed on the threaded portion 20 of shaft 14 adjacent to the limiter nut 84, extends between the surface 77 and a washer 86 disposed on the shaft 14 on the side of the washer 89 facing the end 21. The threaded portion 20 of the shaft 14, which has been threaded through a threaded hole (not shown) of the spreader bar 12, extends through the bar 12. A fixing nut 90 fixedly secures the portion of the threaded portion 20 of the shaft 14 protruding through the aperture of the spreader bar 12 to the shaft 14, and thus the attachment 10 to the spreader bar 12, such that the spring 88 is compressed tightly between the washers 82 and 86. The washer 89 is used, as necessary, to set the axial length of the threaded portion 20 between the spreader bar 12 and the nut 84 to an amount where the spreader bar 12, when secured tightly to the shaft 14, is properly aligned with the shaft 14.

Referring to FIGS. 1, 3, 5A and 5B, a set screw 94 threaded into an aperture (not shown) within the shackle holder 34 secures a flexible shackle 92 to the shackle holder 34 of the hook assembly 16. The shackle 92 extends away from the holder 34 toward the surfaces 37 of the stop 36, defining a space between the shackle 92 and the stop 36 that is too small for a conventional termination of a line of a kite ("chicken loop") to pass therethrough. As well known in the art, a chicken loop is usually about 0.5 inches in diameter and constructed of polyurethane or similar material. The shackle 92 is made of pliable material, such as polyurethane, and preferably in the form of a tube.

The spreader bar 12 is a conventional spreader bar, well known in the industry, and includes two loops 13 at the respective ends to which a harness can be attached. The loops 13 preferably are welded onto the bar 12 in an offset manner, so that the centers of the respective loops 13 are aligned with the center of the hook assembly 16 when the attachment 10 is secured to the spreader bar 12. As discussed below, when a chicken loop is retained within the hook assembly 16, the chicken loop is aligned with the center of the loops 13 at either end of the spreader bar 12. This alignment between the chicken loop and the loops 13 of the hook assembly 16 is advantageous because it reduces the tendency of the attachment 10 to swivel on a harness that is also attached to the loops 13 of the spreader bar 12.

Referring to FIGS. 1, 3, 5A and 5B, and also to FIG. 2, which shows the hook assembly 16 in the open position and the shackle 92 omitted for clarity purposes, an operator of a kite, such as a rider of a snowboard who is controlling a power kite that is pulling the rider, would secure a chicken loop extending from the kite to the attachment 10 as follows. First, the operator moves the chicken loop to the opening 38 of the hook assembly 16. The operator then pulls the chicken loop through the opening 38, which causes the shackle 92 to bend, for example, into the region 39 and toward the fold 43. The bending of the shackle 92 creates sufficient space between the bent shackle 92 and the opposing surface 37 of the stop 36 for the chicken loop to pass relatively unimpeded through the opening 38. Once the chicken loop has sufficiently cleared the opening 38 and entered the region 39, the shackle 92 then returns to an unbent (at rest) position. The surfaces of the hook 32 defining the region 39 of the hook assembly 16 will arrest most rearward movement of the chicken loop within the region 39.

If the chicken loop applies sufficient force to the shackle 92 in the direction away from the fold 43, however, the shackle 92 will bend outwardly, away from the opening 38, such that the chicken loop can move past the shackle 92 and become disengaged from the hook assembly 16. Similarly, the operator can disengage the chicken loop from the hook assembly with relative ease by applying sufficient force onto the chicken loop in the directions of the opening 38 and also the surfaces 37 of the stop 36. When the operator applies such directed force to the chicken loop, the chicken loop is likely not to contact the surfaces of the hook 32 defining the region 39, and the shackle 92 also is likely to be bend outwardly, away from the opening 38, such that the chicken loop would become disengaged or unshackled from the hook assembly 16 with relative ease. Thus, minimal effort by the operator is required to engage and disengage the chicken loop, respectively, to and from the hook assembly 19, and inadvertent disconnects are avoided.

The shackle 92 of the hook assembly 16 advantageously should avoid most inadvertent unhooking of the chicken loop from the hook assembly 16. The material included in the shackle 92 can have varying degrees of flexibility and would be selected in accordance with user preference. The type of shackle 92 included in the hook assembly 16 can be easily adjusted by an operator, because the shackle 92 is simply removed from and attached to the shackle holder 34 with the screw 94.

Further, the shackle 92 advantageously provides that the chicken loop is engaged to the hook assembly 16 without having to lock the chicken loop in place, as required in many prior art devices. The chicken loop is held tightly enough within the region 39 to prevent the chicken loop from accidentally becoming disengaged from the hook assembly 16 should the kite line become slack.

Figure 2:
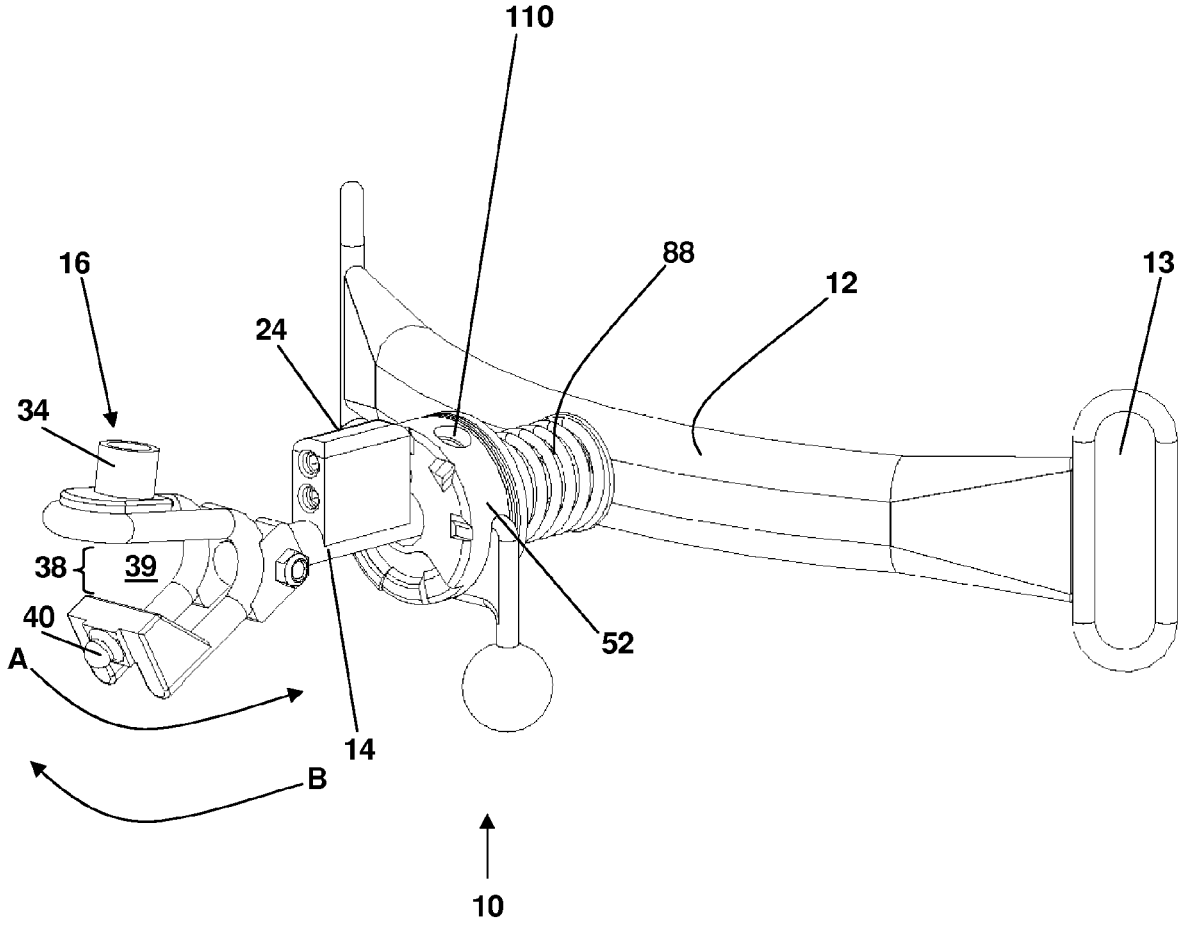
FIG. 2 is a perspective view of the release attachment of FIG. 1 with the hook assembly in the open position and the shackle not shown.

Referring to FIGS. 1-3 and 6, if the hook assembly 16 is in the open position, the operator, using the handle 72, moves the ring 52 of the attachment 10 to a release setting, if the ring 52 is not already at such setting, by rotating the release ring 52 about the shaft 14 so that the cut-away portion 66D becomes aligned with the pin 40 when the hook assembly 16 is pivotally rotated, in the direction of the arrow A as shown in FIG. 2, from the open condition to the closed condition. When the ring 52 is rotated, the spring plunger 54 rotates over the surface 60 and becomes engaged with the groove 62 corresponding to the selected tension setting.

Figure 18:
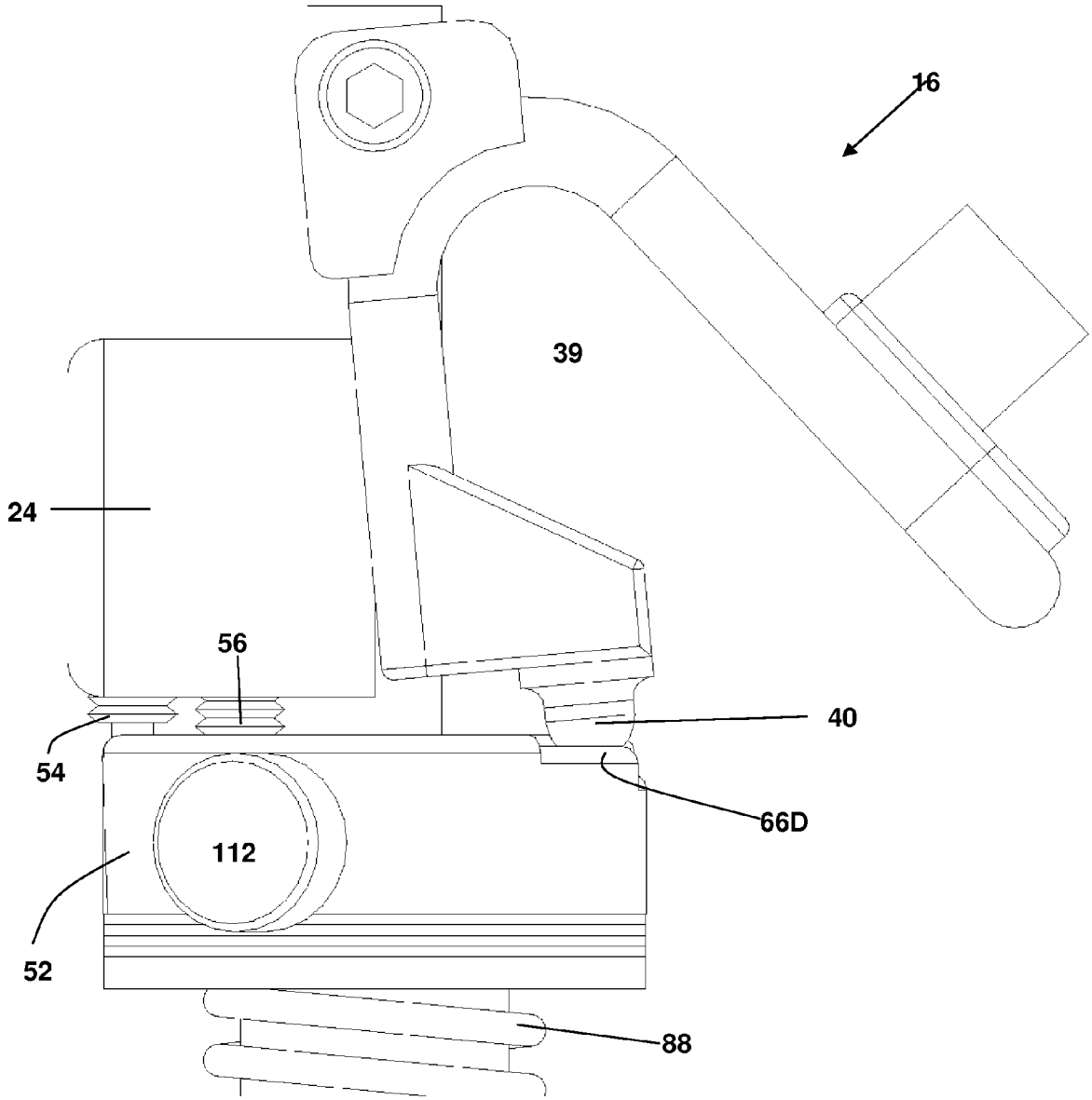
FIG. 18 is a side view of a portion of the attachment of FIG. 1 with the pin of the hook assembly above the release ring and where the shackle is not shown.

After the ring 52 is positioned at the release setting, the operator can easily engage the hook assembly 16 to the ring 52 by rotating the hook assembly 16 in the direction of the arrow A. FIG. 18 shows a side view of the hook assembly 16 where the ring 52 is in the release setting and the pin 40 is over the surface 60 adjacent the groove 64. After the hook assembly 16 is engaged to the ring 52 in the release setting, the operator moves the ring 52 to a selected tension release setting on the ring 52 at which the hook assembly 16 would be automatically released from the ring 52 when the tension of a line coupled to the hook assembly 16 exceeds the release rating of the selected setting. Preferably, the tension line is coupled to the hook assembly 16 after the attachment 10, with the hook assembly 16 in the closed position, is at a desired release setting. For example, the chicken loop of a kite line is engaged to the hook assembly 16 once the hook assembly 16 is in the closed position and a desired release setting has been selected. The kite would be automatically released from the attachment 10 when tension on the line extending from the kite exceeds a tension rating corresponding to the tension release setting selected by the operator.

In the exemplary embodiment of the attachment 10, the attachment 10 has the following user-selectable release settings: release, low, medium, and high or locked. FIGS. 17A, 17B, 17C and 17D are top views of the attachment 10 showing the position of the pin 40 in the groove 64 at the release, low, medium, and high or locked settings, respectively. In an alternative embodiment, a locking mode may be omitted, such as for a beginner's or children's implementation of the attachment 10.

Figure 17A:
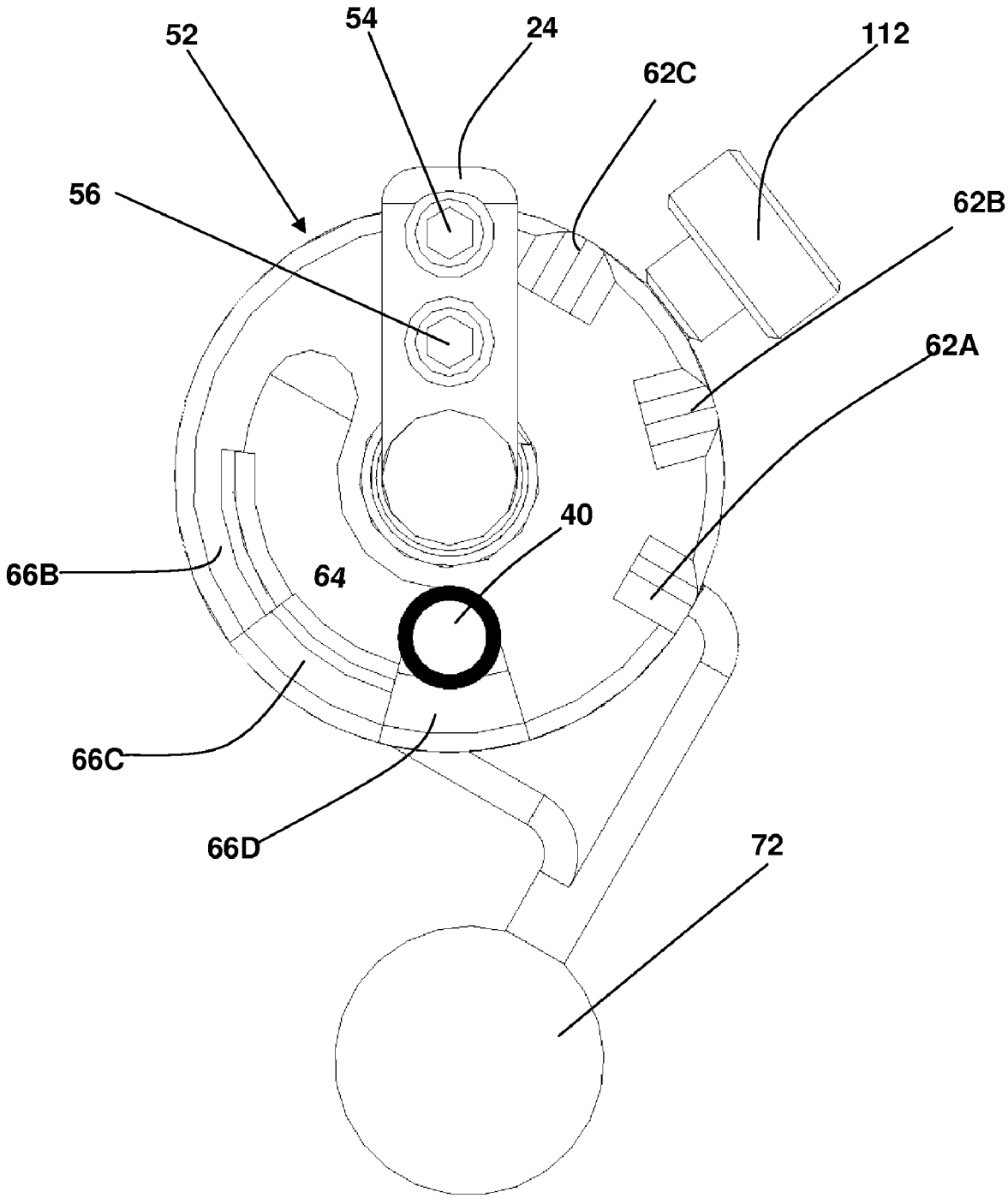
FIGS. 17A, 17B, 17C and 17D are top views of the attachment of FIG. 1, showing only the pin of the hook assembly at release, low, medium, and high settings, respectively.

Referring to FIG. 16A, which is an isometric view of the portion of the surface 60 of the ring 52 at the cut-away portion 66D, and to FIG. 17A, the geometry of the cut-away portion 66D in the surface 60, with respect to the groove 65, provides that, when the hook assembly 16 is moved to the closed position, the pin 40 passes with little or no resistance across the portion 66D, and then the pivoting rotation of the hook assembly 16 is halted when the pin 40 becomes lodged in the groove 64 after clearing the portion 66D. When the attachment 10 is in the release setting, the operator, if desired, can easily rotate the hook assembly 16 in the direction of the arrow B as shown in FIG. 2, which would pull the pin 40 out of the groove 64, across the portion 66D and away from the release ring 52, so that the hook assembly 16 returns the open condition.

Referring to FIGS. 1, 6 and FIGS. 17A-17D, as the ring 52 is rotated, the spring plunger 54 moves into and out of the grooves 62 in the surface 60. When the plunger 54 is within a groove 62, the ring 52 is secured at a selected tension setting for the attachment 10. The grooves 62A, 62B, 62C and 62D are disposed on the surface 60 of the ring 52, such that when the end 55 of the spring plunger 54 is within one of the grooves 62B, 62C and 62D, the pin 40 is positioned within the groove 64 aligned with the cut-away portions 66B, 66C and 66D, respectively. For the illustrated attachment 10, the grooves 66B, 66C and 66D correspond to the medium, low and release settings. In addition, when the screw 54 is positioned at the groove 66A, the pin 40 is positioned at the portion of the groove 64 that is not adjacent to any cut-away portion in the surface 60, or the high or locked setting of the attachment 10. Further, regardless of the position of the ring 52, in other words, the selected release setting, when the hook assembly 16 is engaged to the ring 52, the limiter set screw 56 is slightly spaced from the surface 60 of the ring 52, such that all of the force applied by the spring 88 to the ring 52 is applied to the pin 40. When the hook assembly 16 rotates to the open position for any reason, the limiter set screw 56 limits the movement of the ring 52, thereby allowing easy re-engagement of the hook assembly 16 with the ring 52.

Once the pin 40 is positioned within the groove 64 in the release setting, the operator can select a mode of operation for the attachment 10 by moving the ring 52, using the handle 72, to one of the low, medium, and high or locked settings. When the operator applies force to the handle 72 to rotate the release ring 52, the spring plunger 54 compresses, which allows the ring 52 to rotate. Referring to FIG. 6, the grooves 62B and 62C have beveled surfaces 59A, such as at angle of about 45 degrees with respect to the surface 60, at their circumferential sides, and the grooves 62A and 66D have beveled surfaces 59A at their circumferential sides adjacent the grooves, 62B and 62C, respectively. Further, the grooves 62A and 62D have surfaces 59B at an angle of about 90 degrees with respect to the surface 60 on the circumferential sides opposing the grooves 62B and 62C, respectively. The geometry of the surfaces 59 of the grooves 62 provides that the spring plunger 54 can move in and out of the grooves 62 with relative ease, but cannot be easily rotated in the circumferential direction opposite the grooves 62B and 62C when the plunger 54 is in the groove 62A and 62D, respectively.

Thus, when the spring plunger 54 is moved from the groove 62D to the adjacent groove 62C, the plunger 54 will extend into the next groove 62C, stopping rotation of the release ring 52, which creates a feeling for the operator similar to the ring 52 being stopped by a detent. In this condition, the spring 88, via the washer 82, maintains a force against the release ring 52. The operator can continue to rotate the ring 52, as desired, to achieve the medium or high settings, and the same interaction between the spring plunger 54 and the grooves 62B or 62A would occur. For example, referring also to FIG. 16D, the operator can move the release ring 52 to the high setting where the pin 40 sits in the portion of the annular groove 64 that does not have an adjoining cut-away portion and the plunger 54 is within the groove 62A.

When the chicken loop is engaged in the hook assembly 16 and the hook assembly 16 is the closed condition, the automatic release features of the attachment 10 are in operation. Any line tension on the chicken loop creates a force vector perpendicular to the shaft 14 at the release pin 40. If there is sufficient tension on the line, such as can occur in a dangerous, high wind circumstance, to create a sufficient force on the pin 40, such that the pin 40 compresses the spring 88 to such an extent that the release ring 52 is pushed out of the way of the release pin 40, the release pin 40 then surmounts the wall 65 of the groove 64 and the hook assembly 16 freely rotates to the open position and is no longer engaged with the ring 52. When the hook assembly 16 rotates to the open position in such circumstance, the tension on the line is likely to be sufficient to cause the chicken loop to move very forcefully and quickly towards the shackle 92 at the opening 38, resulting in the almost immediate bending of the shackle 92 away from the region 39, such that the chicken loop quickly disengages from the hook assembly 16.

The spring constant of the spring 88 is suitably selected to provide that selected amounts of tension on a line would cause the pin 40 to become disengaged from the groove 64 when the pin 40 is opposite the various cut-away portions 66, or not adjacent any cut-away portion. The shims 80 may be added or removed from the shaft 14, as desired, to fine tune the tension at which the pin 40 would be released from the groove 64 at the various release settings.

Figure 17B:
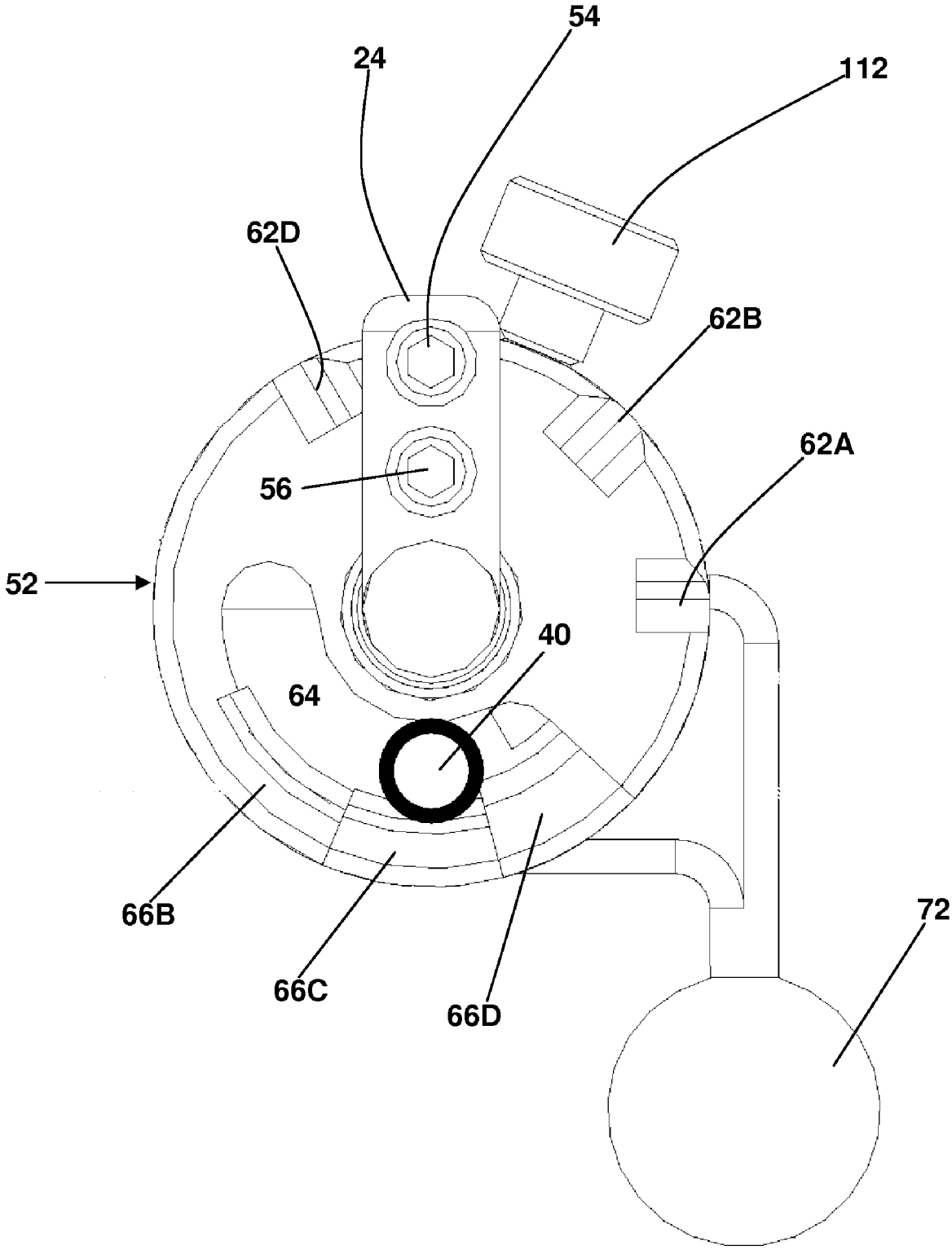
Figure 17C:
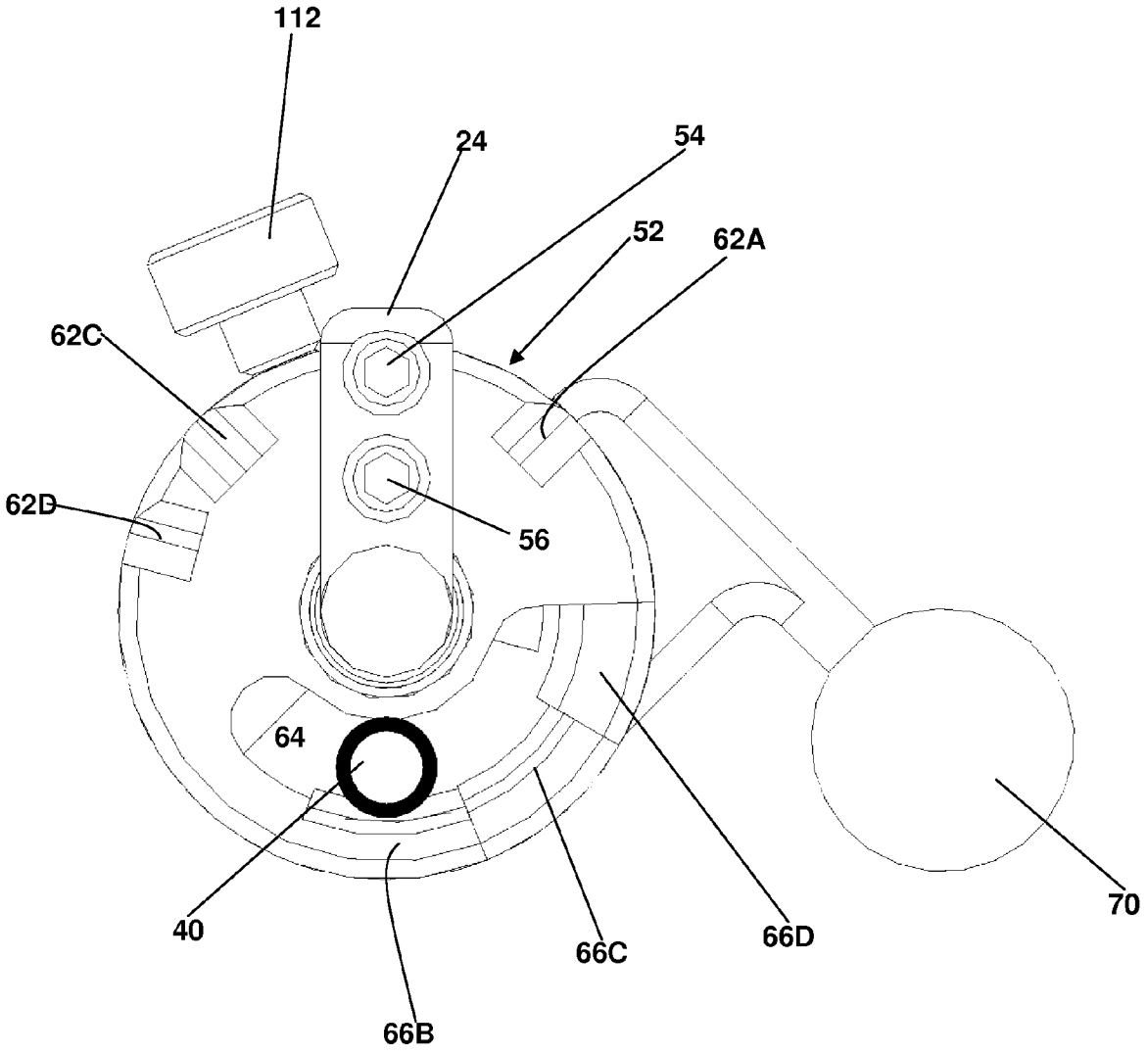
Figure 17D:
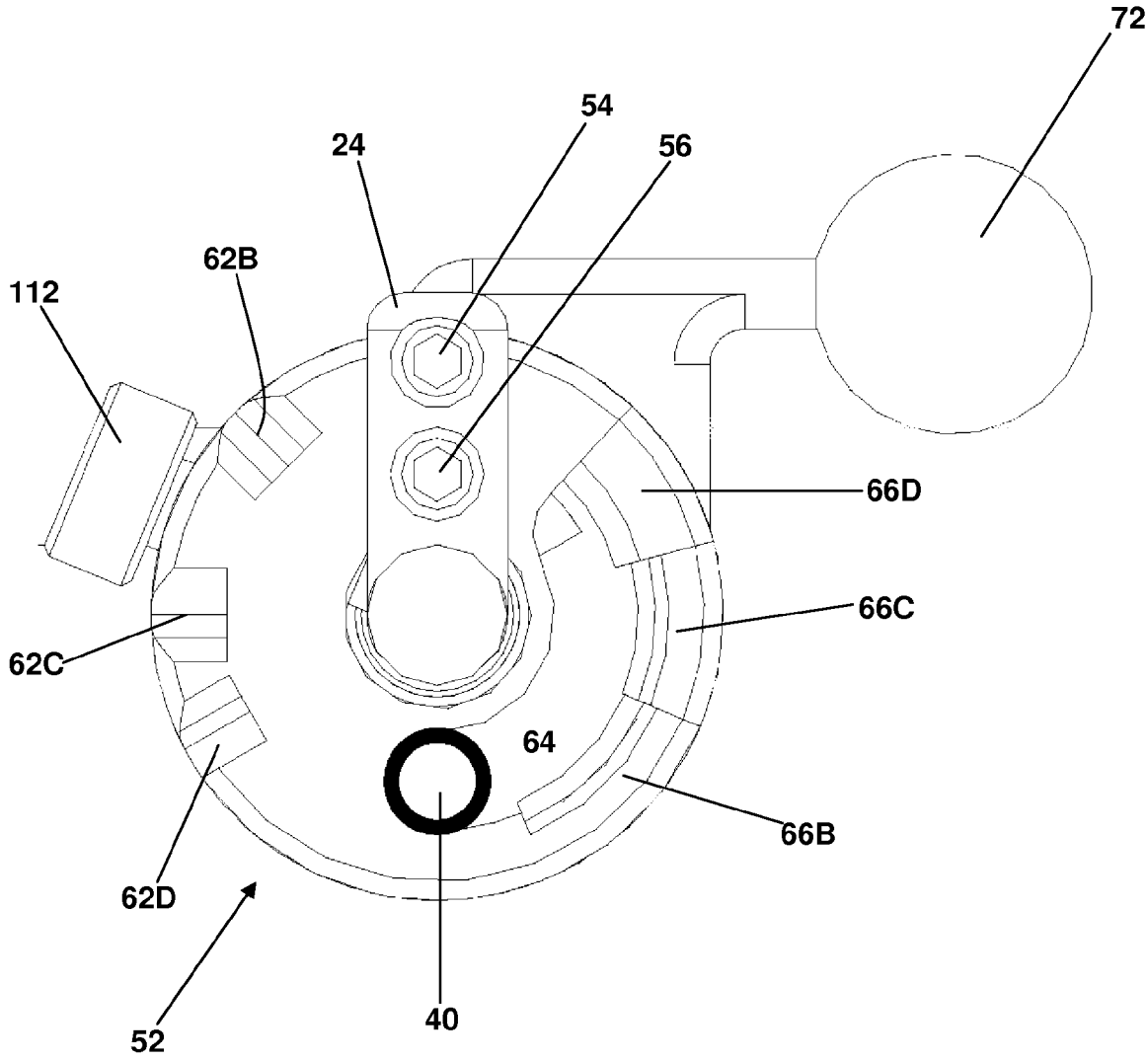

Once in the high setting, the operator can readily switch the attachment 10 to the medium setting by rotating the release ring 52 so that the pin 40 becomes lodged in groove 64 adjacent to the cut-away portion 66B and the screw 54 is opposite the groove 62B. Referring to FIGS. 16C and 17C, in the medium setting, the effective depth of the annular groove 64 is reduced in relation to the actual depth of the groove 64 when the pin 40 is in the high setting. The effective depth of the groove 64 is reduced because the cut-away portion 66B, which can include a bevel in the wall 65, a cut-out in the surface 60 or both, effectively reduces the height of the outer wall 65 adjacent the pin 40, such that less force on the pin 40 would be required to sufficiently compress the spring 88 so that the pin 40 can surmount the outer wall 65 and, thus, become disengaged from the groove 64, as described above.

In a preferred embodiment, the spring constant of the spring 88 is selected such that a tension of about the expected weight of an operator of the kite generates sufficient force on the pin 40 when the attachment 10 is in the low setting to cause the pin 40 to surmount the outer wall 65 of the groove 64 at the cut-away portion 66C. As discussed above, once the pin 40 disengages from the annular groove 64, the hook assembly 16 rotates freely away from the shaft 14 to the open position, such that the chicken loop can readily become disengaged from the hook assembly 16.

By rotating the release ring 52 from the groove 62B to the groove 62C, the attachment 10 is changed to the low setting and the effective depth of the annular groove 64 is further reduced. Referring to FIGS. 16B and 17B, in the low setting, the release pin 40 becomes disengaged from the annular groove 64 at a significantly lower line tension than in the medium setting. To affect a manual release, the operator further rotates the release ring 52 to the last groove 62D to obtain the release setting. In the release setting, the effective depth of the annular groove 64 is at a minimal level, such that the hook assembly 16 will rotate away from the shaft 14 upon the application of a minimal tension to the line.

In a preferred embodiment of the attachment 10, when tension on the kite line increases beyond a level designated as safe, the hook assembly 16 is automatically released from the attachment 10, which in turn permits the chicken loop and thus the kite to quickly disengage from the hook assembly 16, thereby avoiding death or serious injury to the rider. After a manual or automatic release of the hook assembly 16, the operator rotates the release ring 52 to the release setting and re-engages the hook assembly 16 to the ring 52, preferably before re-shackling the chicken loop in the region 39.

Advantageously, the inventive automatic release attachment eliminates human reaction time as a factor controlling the release of a kite line when a dangerous high tension circumstance arises, thereby affording a level of safety not currently available in prior art manual kite release devices. Further, the inventive automatic release attachment makes shackling and unshackling of the chicken loop more convenient for the operator than otherwise available in the prior art.

It is to be understood that the desired tension for release in each setting is variable and the type of kite, the sport involved, for example, snow kiting or kite boarding, rider preference and rider skill can all play a large part in the selection of a release tension. In a preferred embodiment, the release tension ratings in the low and medium settings are between 70% and 105% of operator weight and at 130% to 150% of the low setting, respectively. Calibration of the attachment 10 is readily performed by adding or removing the shims 80.

It is noted that an apparatus desirably should have redundant safety devices, and that the failure of one safety device on the apparatus should not disable any of the other safety devices. The inventive automatic release attachment advantageously increases the safety of an operator, such as a kite-boarder, because the attachment can fail only to safe or neutral conditions. First, the attachment 10 could fail to the open, or fail safe, position, where the chicken loop is released from the attachment. Second, the attachment 10 could fail to the locked, or fail neutral, position, where the hook assembly 16 is locked within the groove 64 and cannot be disengaged therefrom. In the latter circumstance, the operator can bend the shackle 92 and then pull the chicken loop over the bent shackle 92 to disengage the chicken loop from the hook assembly 16 and, thus, the attachment 10.

In one exemplary application, a rider of a snowboard who desires to be towed by a kite uses the attachment 10 to provide for an automatic release of the kite termination at several selectable release settings, each having a different automatic release tension. It is known that, when a gust wind acts on a kite whose termination is locked in place, the wind can generate sufficient tension on the line to loft the rider over 50 feet in the air. The automatic release features of the attachment 10 would prevent such occurrence. For example, the most dangerous time for a kite-boarder is when the kite is airborne while at the beach, including launching and landing of the kite. In such circumstances, the rider requires the least amount of power from the kite. The next most dangerous phase of kite-boarding is when the rider initially moves away from, or returns to, shore. The safest phase of kite-boarding is when the rider is far from land, during which time the rider may initiate the more extreme maneuvering, including higher speeds and jumping. The inventive automatic release attachment, with four selectable tension release settings, would accommodate these different phases of kite-boarding. In a first or release setting, the attachment 10 releases the kite when a minimum of tension is on the line. The release setting is used to manually initiate release, as well as to re-engage the hook assembly 16 to the release ring 52 after a release. A second or low release setting is selected by the operator to launch or land the kite. At the low setting, the attachment 10 automatically releases the kite when the tension on the line is at a level significantly less than the rider's weight. A third or medium setting is used when the rider rides away from, and back to, shore. At the third setting, the kite will be released when the tension on the line is at a level somewhat above the rider's weight. Moderate riding, including very gentle jumps, are possible at the third setting. In addition, the rider could use the third setting in the event adverse weather conditions develop while the rider proceeds back to shore. A fourth or high setting is selected when the rider prepares to begin advanced maneuvering. At the fourth setting, the kite will be released when the tension on the line is at a level significantly above the rider's weight, and preferably is many times the weight of the rider. The attachment 10 is considered locked at this level, such that automatic release cannot occur. The locked setting may be desirable by the rider who desires to perform intentional jumps and other advanced maneuvers where the line tension would equal or exceed the line tension that could be dangerous if the rider is still on shore.

In another embodiment, the groove 64 of the attachment 10 has a depth providing that the high setting is not a locked setting and the pin 40 automatically releases at some tension above a rider weight, for example, at about 200% of a rider's weight. In this embodiment, the attachment allows the rider to perform all but the most extreme maneuvering.

Referring to FIGS. 1, 3 and 17A-17D, in a preferred embodiment, the attachment 10 includes a retractable quick release spring plunger 112 which extends through the release ring 52 at the aperture 110, the aperture 51A in the bearing 50 and is secured to the shaft 14 at the aperture 22, when the ring 52 is rotated to a setting where the aperture 51A of the bearing 50, which is press fit to the ring 52, is aligned with the aperture 22 in the shaft 14. In the preferred embodiment, the aperture 22 is aligned with the aperture 51A when the ring 52 is in the high or locked setting. As the ring 52 is rotated to obtain the locked setting, the force of the spring of the plunger 112 causes the plunger 112 to snap into the aperture 22 in the shaft 14, thereby preventing all movement of the ring 52 until the plunger 112 is manually retracted from the aperture 22.

The plunger 112, when used with the attachment 10, thus, prevents the release ring 50 from rotating about, or moving axially along the length of, the shaft 14. When the attachment 10 is in the high or locked setting, the plunger 112 blocks movement of the ring 52, such that the attachment 10 is in a locked mode. To deselect the locked mode, the operator must simultaneously pull against the plunger 112, so that it no longer bears against the shaft 14, while rotating the release ring 52 out of the locked setting. The plunger 112, however, does not change the automatic release features of all of the other settings of the attachment 10, because the plunger 112 would not be secured to the shaft 14 in such settings.

In an alternative embodiment, the plunger 112 is omitted from the attachment 10 and a simple set screw seals the aperture 110 but does not extend into the aperture 51A of the bearing 50. The use of the plunger 112 with the attachment 10, for example, may be desirable for very extreme jumping over shallow water to eliminate the possibility of the locked mode disengaging accidentally.

In a preferred embodiment, the ring 52 is not rotatable and the hook assembly 16 includes several pins 40, which provide that less load is placed on each pin 40 when engaged in the groove 64. Instead of the groove 64, the ring surface 60 includes a plurality of semi-spherically shaped indents, each having a cutout similar to the geometry of the cutout 66C, and the pins 40 would engage the respective shaped indents. When a force in the direction of the spreader bar 12 is applied to a lever attached to the ring 52, where the lever, for example, is the handle 72, the release ring 52 is forced downward against the spring 88, thereby allowing manual release.

In another embodiment, the ring 52 is not rotatable and the hook assembly 16 includes a single pin 40 and the ring surface 60 includes is a single corresponding indent 66 in the ring surface 60 for receiving the pin 40. In a further embodiment, the attachment 10 including the non-rotatable ring 52 with the single pin 40 and corresponding single indent 66 also includes the plunger 112. The plunger 112, when secured to the shaft 14, prevents axial movement of the non-rotatable ring 52, thereby placing the attachment 10 in locked mode. In this embodiment, the attachment 10 includes only the release settings of manual release, automatic release and locked.

In still another embodiment, the attachment 10 is mounted inline between a kite line and the chicken loop of the kite line, rather than to the spreader bar 12, where the end 21 of the shaft 14 is for engagement with a chicken loop and the hook assembly 16 is for engagement with the front lines of the kite.

In still a further embodiment, the shackle 92 is constructed of a material or materials that provide that the shackle 92 only has sufficient strength to hold the chicken loop or a like termination within the region 39 to prevent accidental release, in other words, when there is minimal, or the absence of any, tension on the line.

Figure 15A:
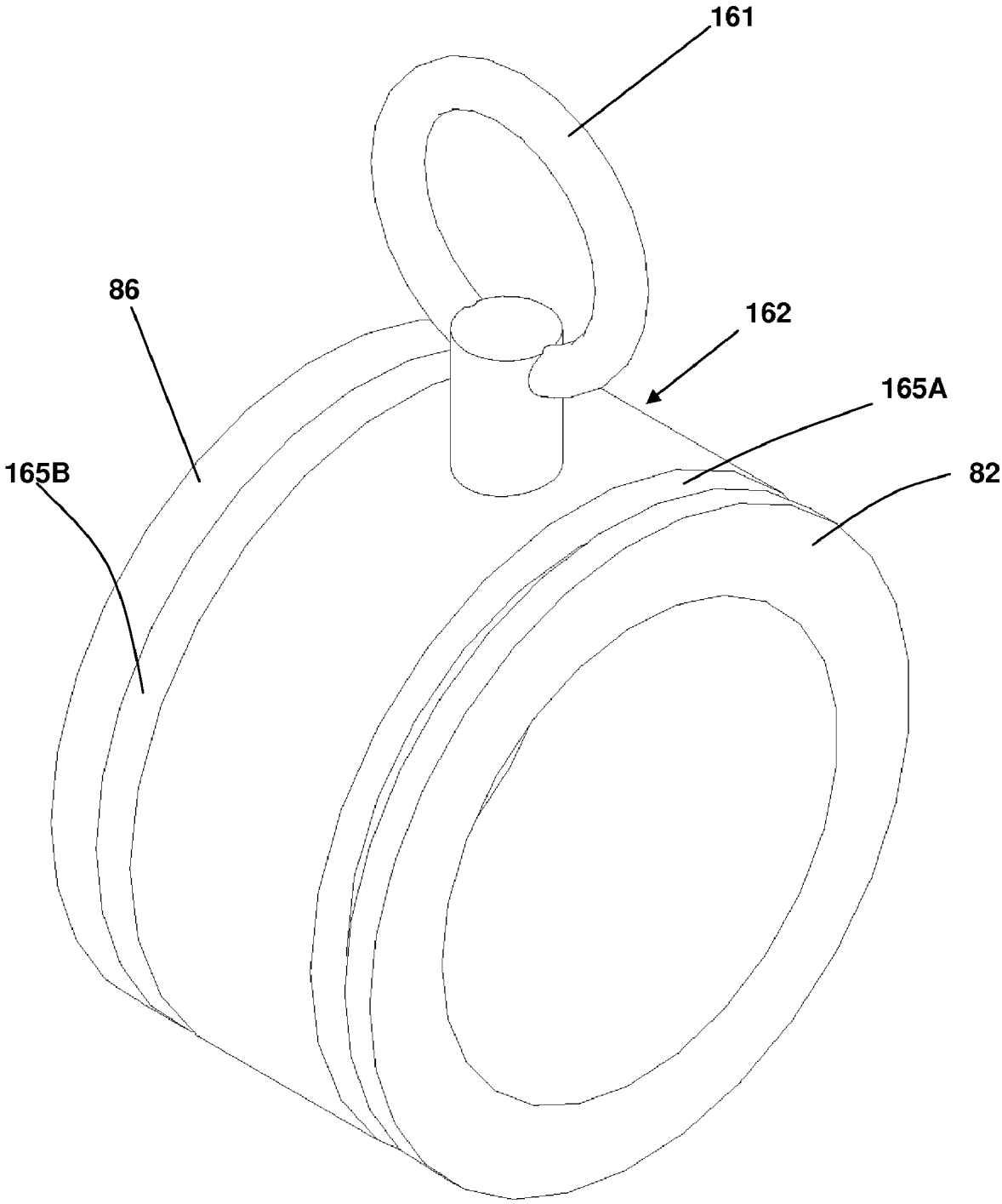
FIG. 15A is a perspective view of a portion of the automatic release attachment of FIG. 1 including a rotating leash collar, in accordance with the present invention, and where the shaft and spring have been omitted.

In a preferred embodiment, the attachment 10 includes a rotating leash collar 162 encircling the spring 88. Referring to FIG. 1, and also to FIG. 15A which shows the portion of the shaft 14 of the attachment 10 at which the collar 162 would be disposed and omits the spring 88 for clarity purposes, the collar 162, which is in the form of a tube and has a loop 161 extending therefrom, has an axial length that is less than the axial distance between the washers 86 and 82 on the shaft 14, such that when the collar 162 is centered between the washers 86 and 82, the collar 162 is axially spaced from the washers 82 and 86 by gaps 165A and 165B, respectively. When a leash of a kite is attached to the loop 161 of the collar 162, the collar 162 rotates about the shaft 14 when the control bar of the kite is rotated. It is noted that, in this embodiment, if the leash exerts any pull on the collar 162 prior to automatic release of the hook assembly 16, the effective release tension rating for a selected setting for the attachment would increase, because the collar 162, in addition to the spring 88, would be applying force to the release ring 52.

Figure 15B:
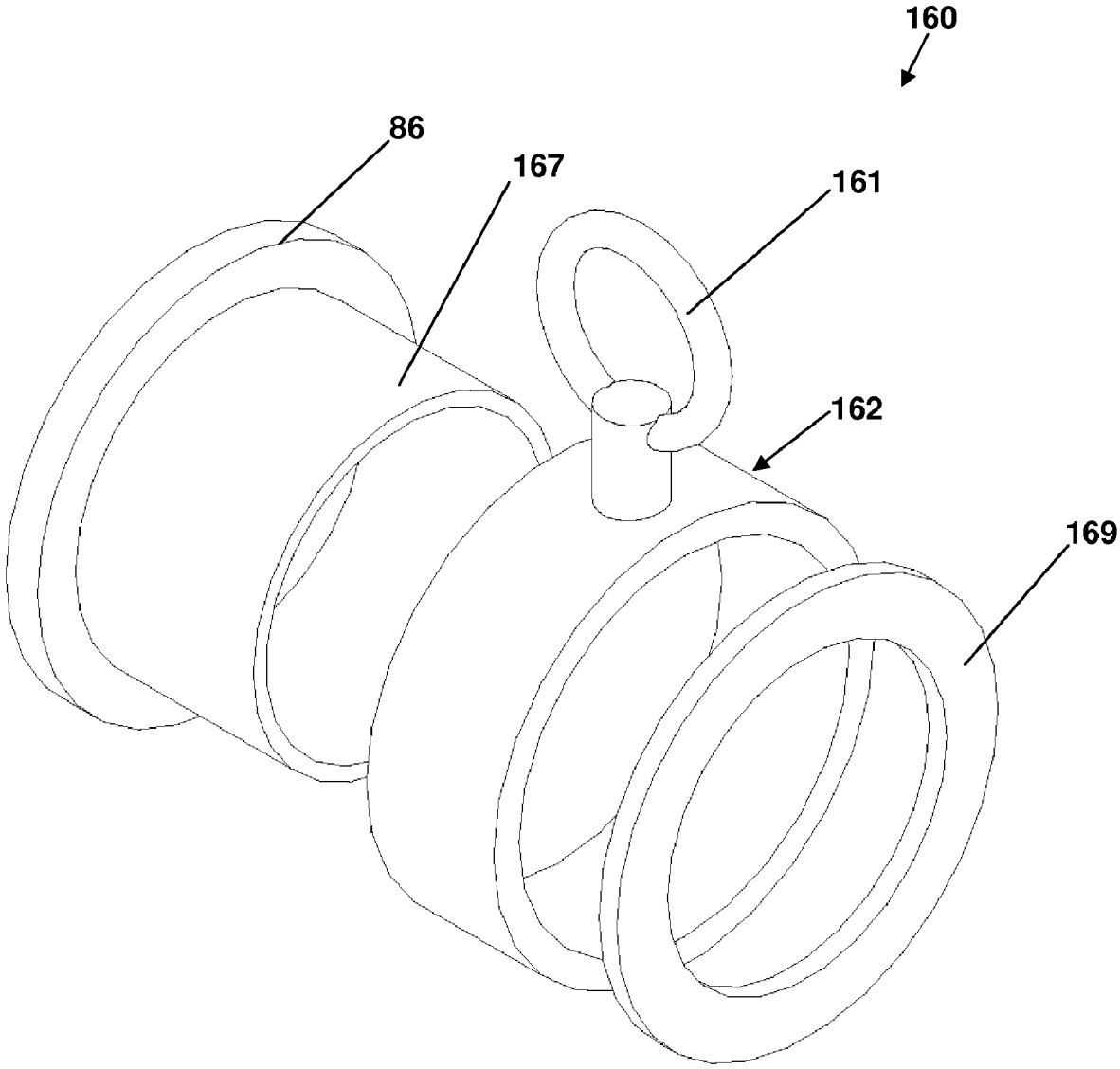
FIG. 15B is an exploded view of a rotating leash collar assembly, in accordance with the present invention, shown in relation to the washer of the automatic release attachment of FIG. 1 to which the collar assembly is secured.

In a preferred embodiment, a leash collar assembly 160, as shown in exploded view in FIG. 15B at the portion of the shaft 14 of the attachment 10 at which the collar assembly 160 would be disposed and with the spring 88 omitted for clarity, includes the collar 162 that can rotate about the shaft 14, but would not apply any force to the release ring 52 during rotation. Referring to FIGS. 1 and 15B, the collar assembly 160 includes a tube 167 whose inner diameter exceeds the outer diameter of the spring 88 (not shown) and axial length is slightly longer than the axial length of the leash collar 162. The collar 160 encircles the tube 167, which at one end is welded to the washer 86. A washer 169 having the same inside diameter as the tube 163 is welded onto the other end of the tube 163. The collar 162, thus, is locked within the axial space on the shaft 14 extending between the washers 86 and 165, in other words, can move axially along the length of the shaft 14 only between the washers 86 and 165. When the collar 160 rotates about the shaft 14, the collar 160 rotates in relation to the washer 86, which is fixed in place and, therefore, fixes the assembly 160A in place. Thus, although the collar 160 may exert a force against the washer 169, the fixed washer 86 prevents the collar 160 applying such force to the ring 52 and, thus, prevents a change to the effective tension release rating for a selected release setting.

Figure 7:
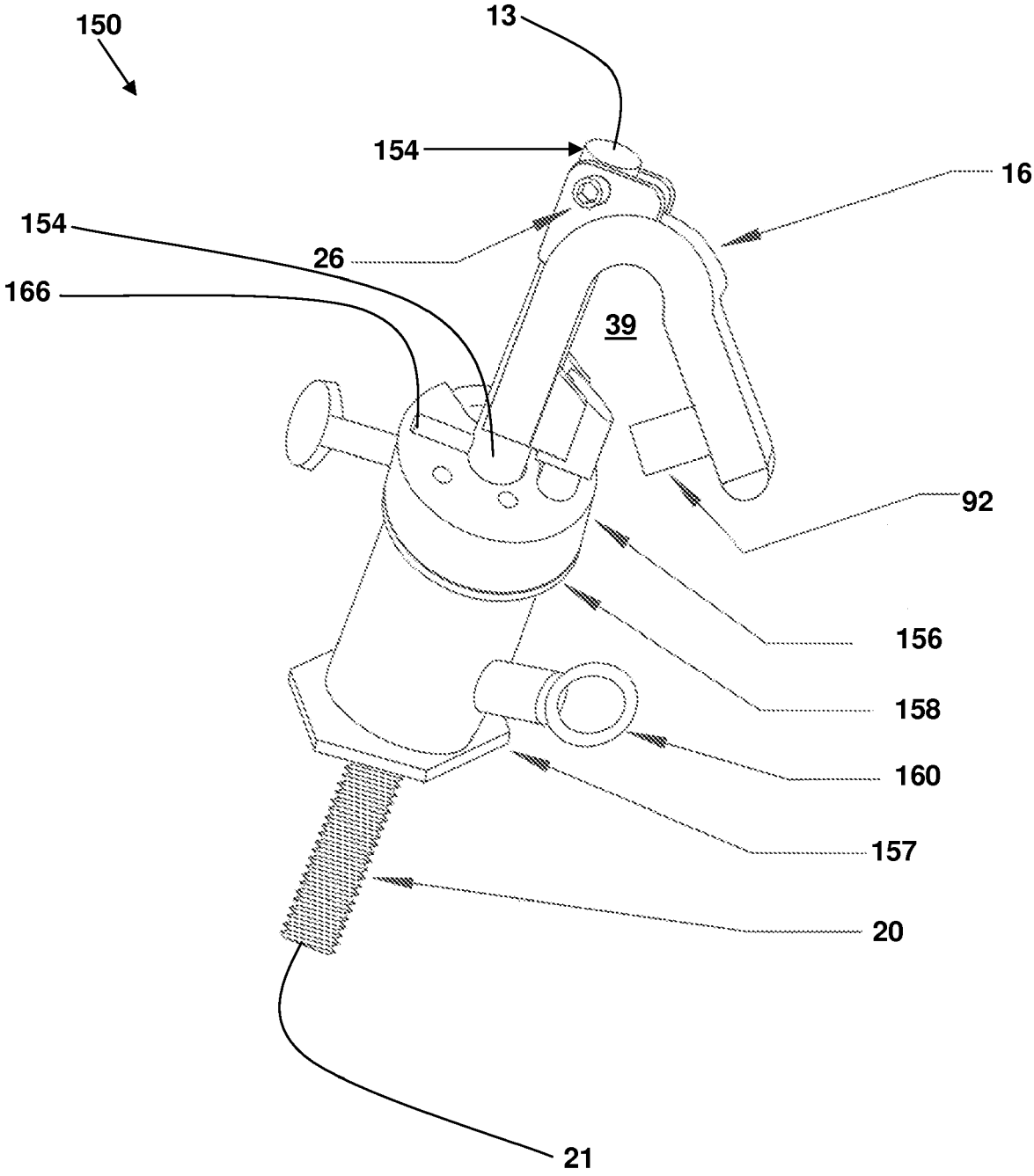
FIG. 7 is a perspective view of another embodiment of an automatic release attachment, in accordance with the present invention, with a hook assembly in the closed position.
Figure 8A:
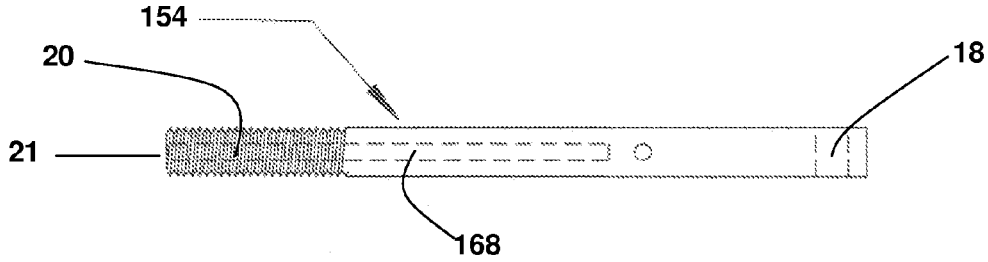
FIGS. 8A, 8B, 8C and 8D are isometric views of the shaft of the release attachment of FIG. 7.
Figure 8B:
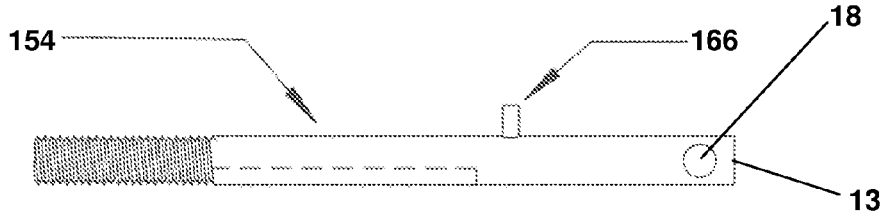
Figure 8C:
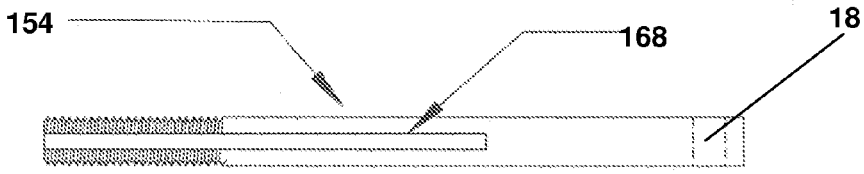
Figure 8D:
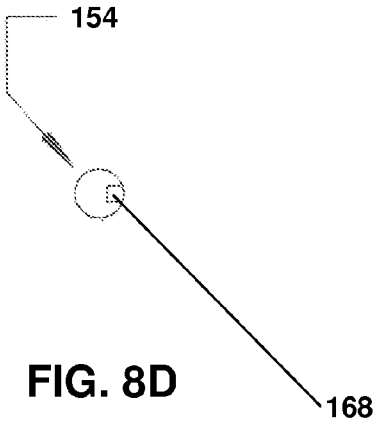

FIG. 7 illustrates another preferred embodiment of an automatic release attachment 150 in accordance with the present invention. The attachment 150 is similar in construction and operation to the attachment 10 described above, and like reference numerals are used to describe components having similar or identical construction and operation as those contained in the attachment 10. Referring to FIG. 7, the attachment 150 includes a hook assembly 16 pivotally secured to a main shaft 154, as shown in greater detail in FIGS. 8A, 8B, 8C, and 8D, at an aperture 18 adjacent end 13 of the shaft 154. The hook assembly 16 is identical to that contained in the attachment 10, except that the shackle holder 34 is contained within the brackets 30 of the hook 32 and does not extend opposite the region 39 defined by the hook assembly 16.

Figure 9:
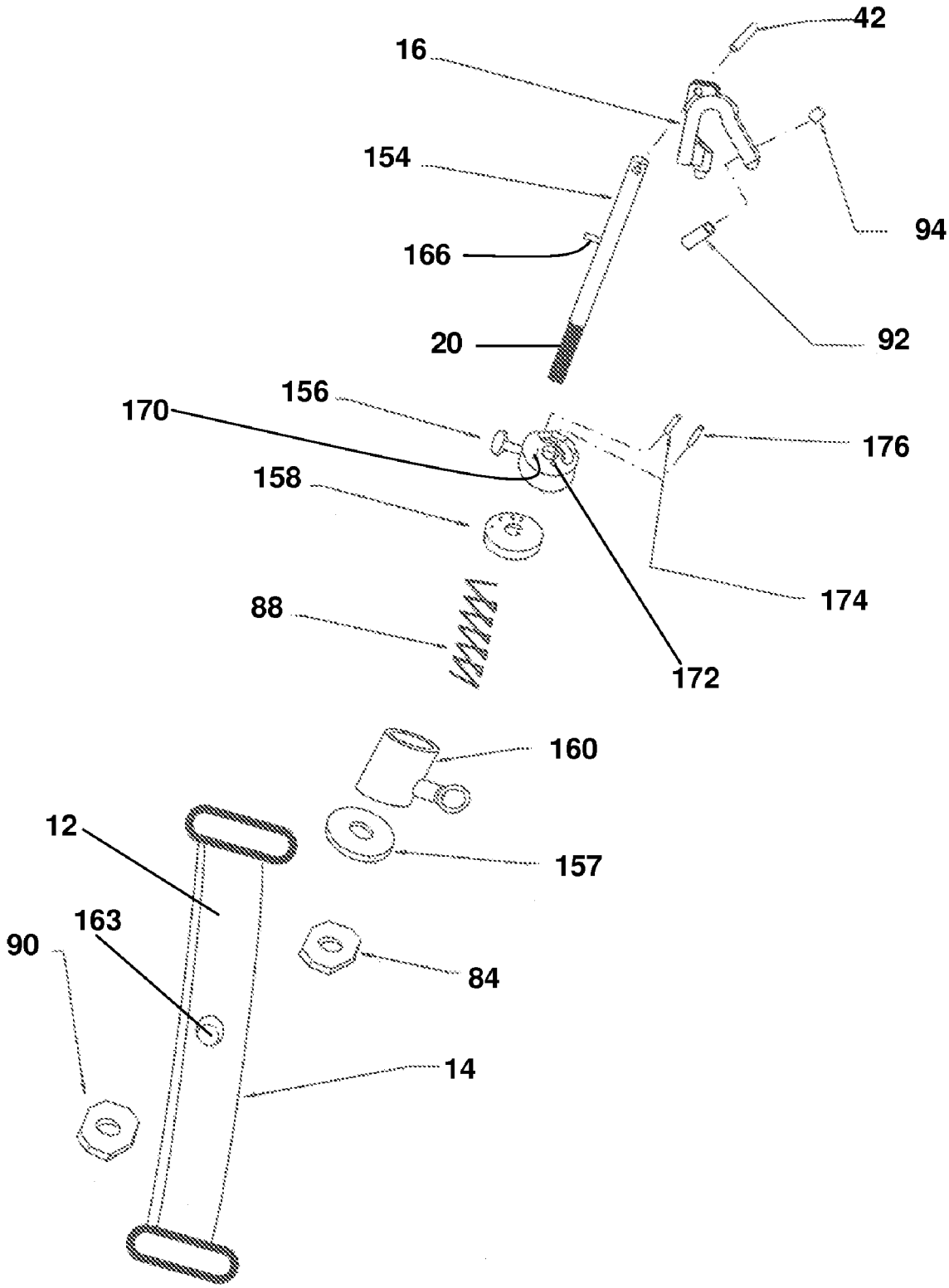
FIG. 9 is an exploded view of the release attachment of FIG. 7 shown in relation to a spreader bar.

Referring to FIG. 7 and also to FIG. 9, which shows the attachment 150 in exploded view in relation to a spreader bar 12, a release ring 156 and a detent ring 158, which in combination provide the same automatic release functionalities as the ring 52, are disposed on the shaft 154 between the hook assembly 16 and a spring 88. An optional rotating leash collar 160 encircling the spring 88 is disposed between the detent ring 158 and an optional tension adjusting spring washer 157. A nut 84 is secured to the threaded portion 20 of the bar 154, and a nut 90 is secured to the portion of the threaded portion 20 of the bar 154 extending through an aperture 163 in the spreader bar 12.

Referring to FIG. 7 and FIGS. 8A, 8B, 8C and 8D, the bar 154 includes a limiter boss pin 166 disposed on the bar 154 at about the same position as the boss 24 is disposed on the bar 14. In addition, the bar 154 includes a groove 168 extending between the end 21 of the bar 14 and the limiter pin 166.

Figure 10:
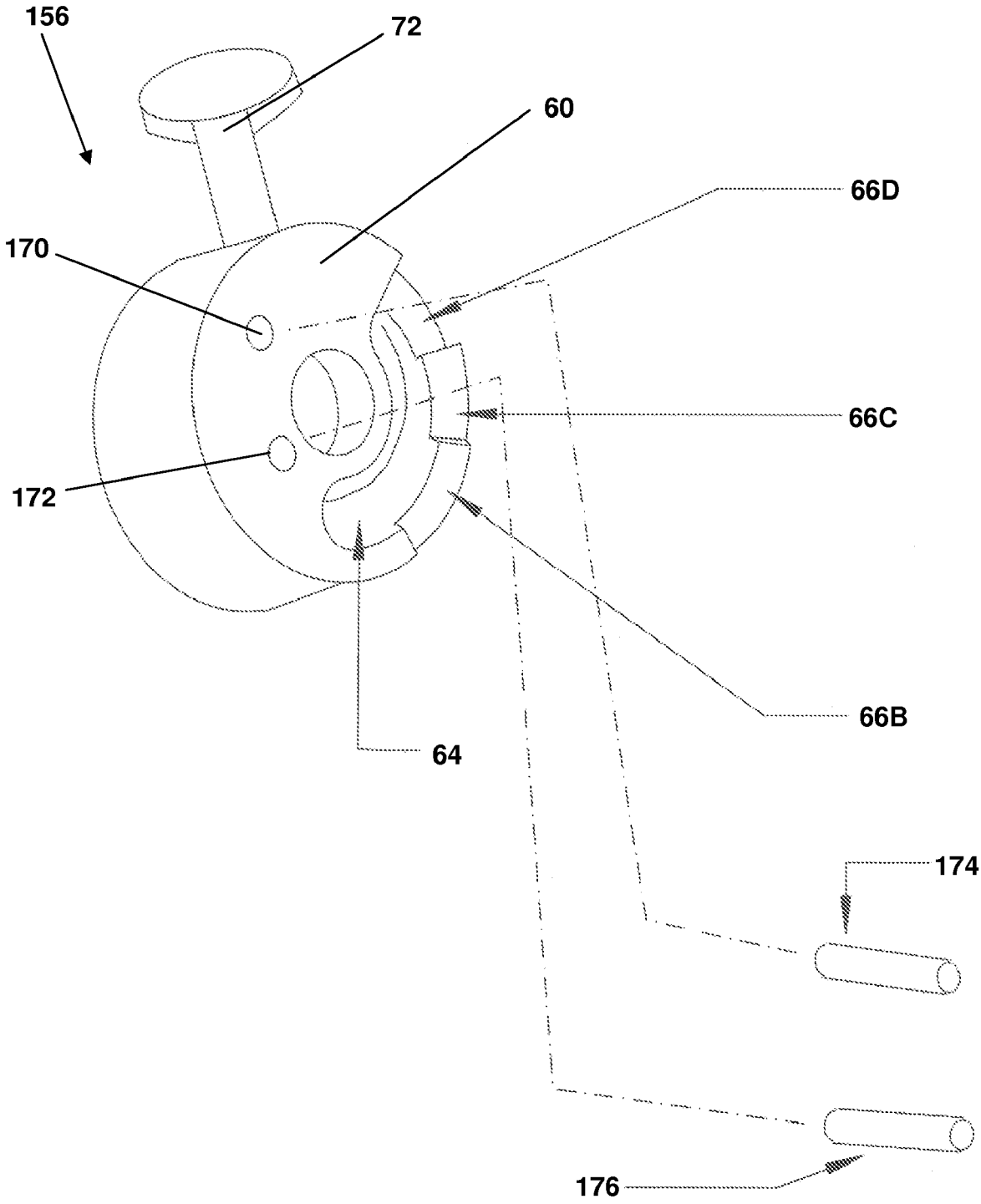
FIG. 10 is a perspective view of the release ring of the release attachment of FIG. 7 with the set screws shown in exploded view.
Figure 11:
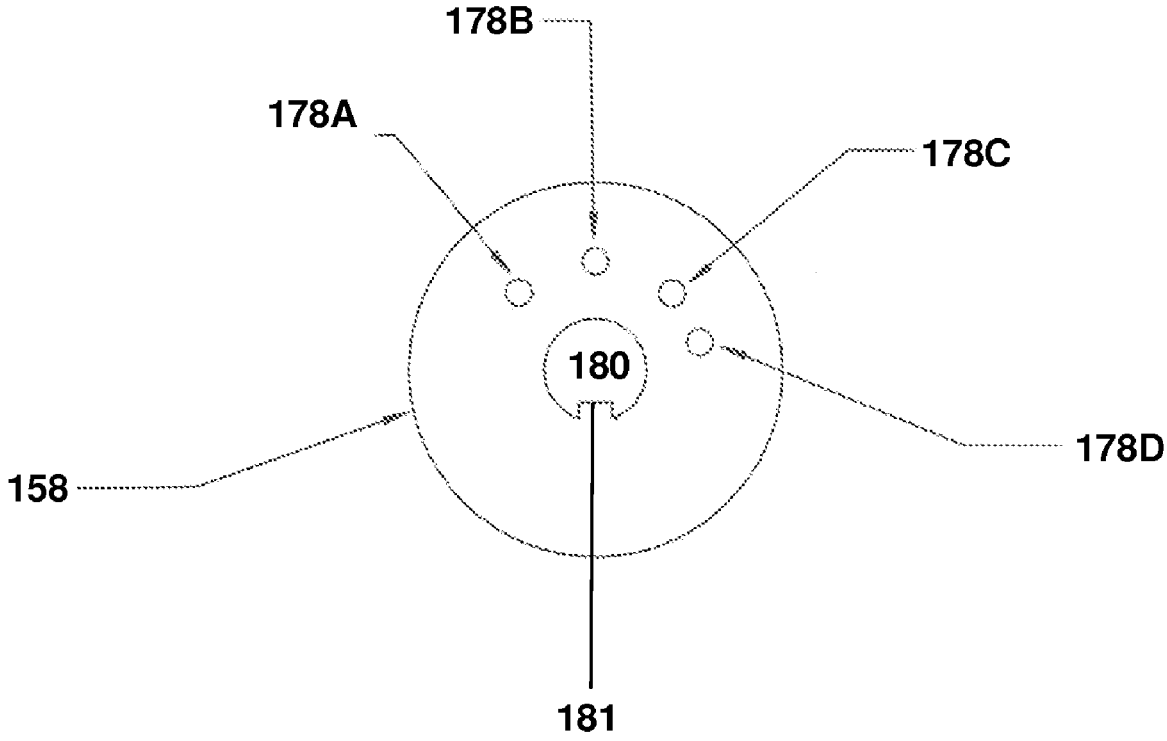
FIG. 11 is a top view of the detent ring of the release attachment of FIG. 7.

Referring to FIGS. 7, 9 and 10, the release ring 156 includes an annular groove 64 and cut-away portions 66B, 66C and 66D. In addition, threaded apertures 170 and 172 are defined in a surface 63. A release set screw 174 is threaded into the aperture 170 so that the top of the set screw 174 is slightly above the surface 60 of the release ring 156. Referring to FIG. 11, the detent ring 158 includes holes 178A, 178B, 178C and 178D in an annular configuration and spaced from each other, where the holes 178B, 178C and 178D are spaced in correspondence with the spacing of the cut-away portions 66B, 66C and 66D on the release ring 156. In addition, center aperture 180 of the ring 158 includes a key 181 which is matched to the groove 168 in the bar 154. When the ring 158 is installed onto the bar 154, the key 181 slides into and along the groove 168 to the furthermost portion in the direction of the end 13 of the shaft 154, such that that the ring 158 is fixed in placed on the shaft 154 at such portion of the groove 168.

Operation of the attachment 150 is similar to that of the attachment 10, in that, after the chicken loop is initially engaged to the hook assembly 16, preferably while the hook assembly 16 is in the open position, the hook assembly 16 is rotated to the closed position and the detent set screw 176 is threaded into the aperture 172 so that the end of the screw 176 opposing the detent ring 158, which is preferably oval in shape, engages the detent hole 178. When the pin 40 is engaged to the groove 64, the pin 40 can be positioned in the groove 64 not opposite a cut-away portion and opposite the cut-away portions 66B, 66C and 66D, respectively and the screw 176, in turn, would be engaged within a corresponding one of the detent holes 178A, 178B, 178C and 178D. The size of the detent holes 178 determines the detent force on the ring 156. Therefore, if a spring 88 with a higher spring constant is used, the diameter of the holes 178 on the ring 158 can be reduced. Similarly as described above for the attachment 10, placing the screw 176 into one of the detent holes 178A, 178B, 178C and 178D sets the attachment 150 to the release settings of high, medium, low and release, respectively.

When the hook assembly 16 is in the closed position with the screw 176 in one of the detent holes 178, the spring 88 forces the detent ring 158 against the release ring 156, and the limiter pin 166 limits the extent that the spring 88 forces the rings 156 and 158 against the pin 40 of the hook assembly 16. The operator can select a different release setting by rotating the ring 156 so that the detent screw 176 engages another of the detent holes 178. While the ring 156 is being rotated, the pin 40 simultaneously moves annularly in the groove 64 to a different position, for example, adjacent another of the cut-away portions 66, and the screw 176 would engage the corresponding detent hole 178.

It is noted that when the release ring 156 is rotated to the release setting to effect a manual release, the detent screw 176 engages the detent hole 178D and the set screw 174 is now aligned with and under the motion limiter pin 166. As the release set screw 174 is set preferably slightly above the surface of the release ring 156 in this setting, some of the force that the spring 88 applies to the pin 40 is transferred to the release set screw 174, such that the hook assembly 16 can rotate away from the bar 154 when only a small force is applied to the hook assembly 16. The release set screw 174 can be adjusted within the aperture 170 by the operator to establish a preferred force for disengaging and reengaging the hook assembly 16 to the ring 156.

Figure 12:
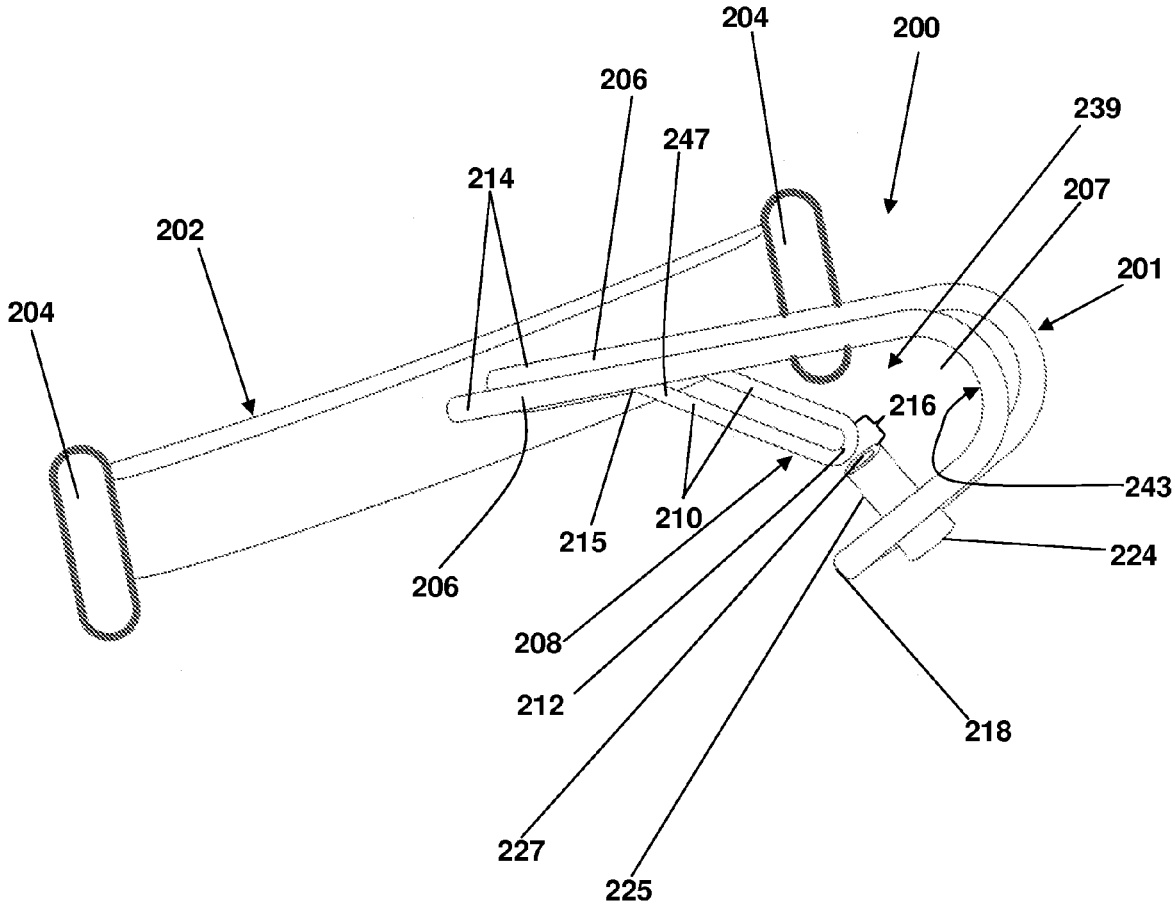
FIG. 12 is a perspective view of an embodiment of a hook assembly extending from a spreader bar in accordance with the present invention.

Referring to FIG. 12, a hook assembly 200, in accordance with the present invention, is welded or otherwise attached to a spreader bar 202 including hooks 204 at the opposing ends. The spreader bar 202 is similar in construction to the spreader bar 12, except that the bar 202 does not include an aperture between the hooks 204. The hook assembly 200 includes a folded U-shaped bracket or hook 201 having a folded portion 243, as is conventional in the art. The hook 201 includes parallel legs 206, spaced from each other, extending away from the spreader bar 202 and then curving toward and joining each other after the fold 243 to define a region 239 for retaining a chicken loop. In addition, the hook assembly 200 includes a retaining bar 208 having spaced legs 210 extending away from adjacent the spreader bar 202, along the surface portions of the legs 206 facing the region 239 and then bending away from the legs 206, preferably at about a 30 to 45 degree angle with respect to the legs 206, into the region 239 and terminating as a joined portion at an end 212. The legs 210 of the bar 208 are welded or otherwise attached to the adjoining surfaces of the legs 206, forming a junction 247 facing the region 239.

Figure 13:
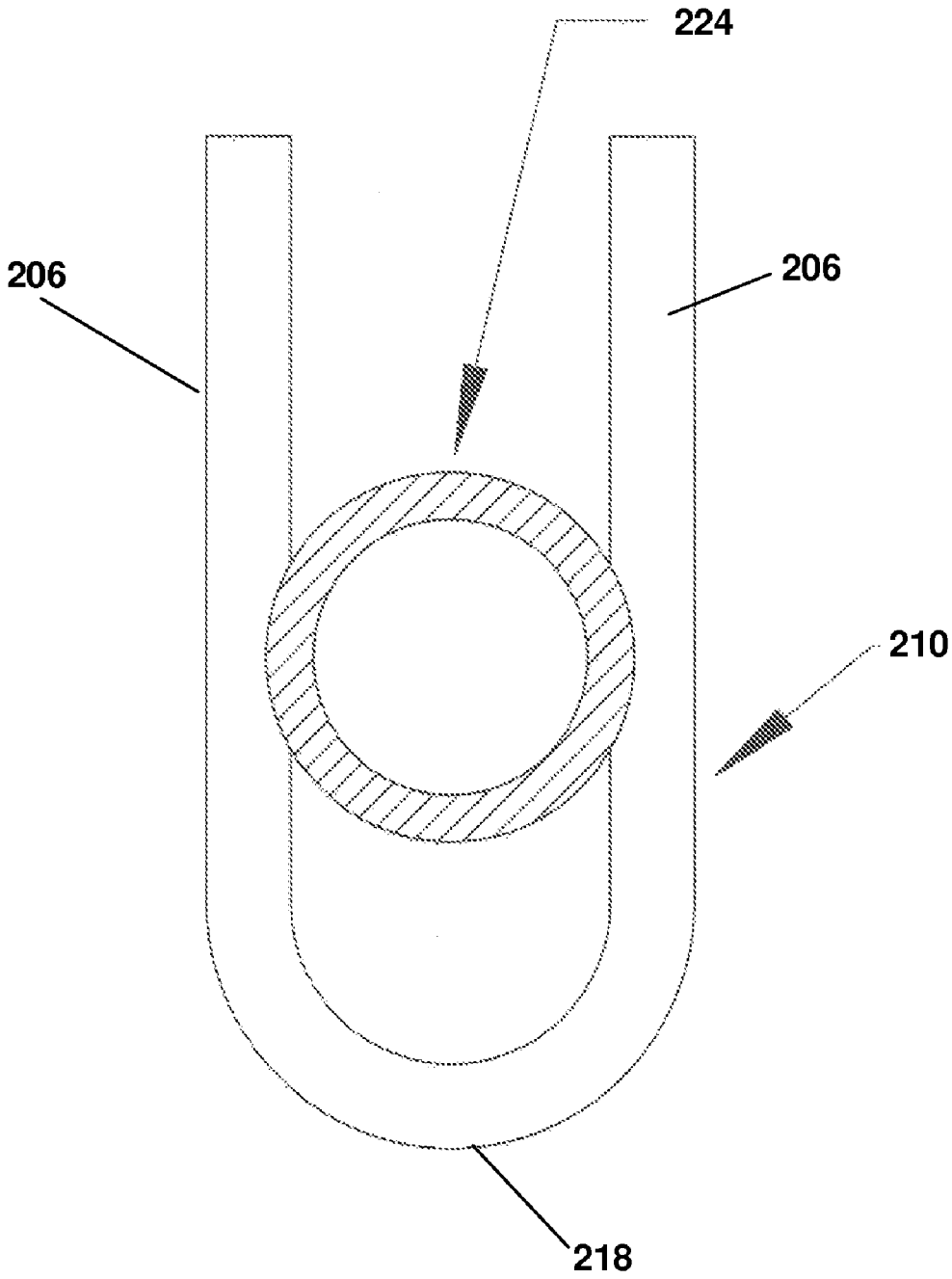
FIG. 13 is a partial, bottom view of the hook assembly of FIG. 12.
Figure 14:
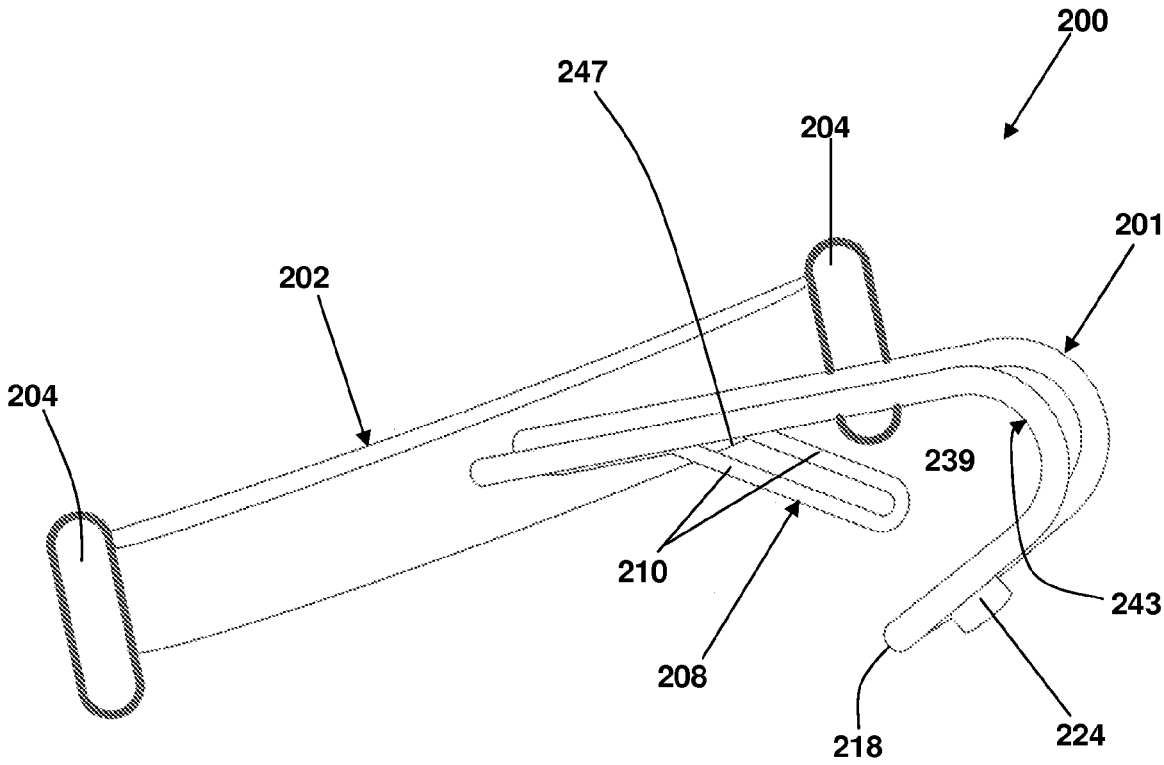
FIG. 14 is a perspective view of the hook assembly as shown in FIG. 12 with the shackle removed.

Referring to FIG. 12, and also to FIG. 13, which is a partial view of the end 218 of the hook assembly 200, a bushing 224 is welded or otherwise attached in the space between the legs 206 adjacent the end 218 of the hook 201. The bushing 224 is mounted so that a straight line from about the center of the bushing 224 intersects the free end 212 of the retaining bar 208. A shackle 225, similar to the shackle 92 described above, is mounted inside the bushing 224 by a set screw (not shown), similar to the screw 94 described above, which is threaded into the shackle 225 from the outside of the hook 201 so that the shackle 225 is flush with the edge of the bushing 224 which is outside the hook 201. End 227 of the shackle 225, opposing the end 212 of the retaining bar 208, is close to, but does not touch, the retaining bar 208. The end 227 of the shackle 225 and the end 212 of the retaining bar 208 define a gap 216 therebetween. When the shackle 225 is not bent, the gap 216 is sufficiently small so that the chicken loop cannot pass through the gap 216.

The set screw for the shackle 225 is selected so that it is flush with both ends of the bushing 224, and holds the shackle 225 with a predetermined force inside of the bushing 224. A predetermined force needs to be applied to the shackle 225 to cause the shackle 225 to bend a sufficient amount, such that the gap 216 sufficiently increases to allow the chicken loop to pass therethrough. Like the shackle 92, the shackle 225 can have varying degrees of flexibility and is easily replaceable. The operator of the hook assembly 200, therefore, can select from several different shackles 225 to control the amount of force that would need to be applied to the shackle 225 to unshackle the chicken loop from the hook assembly 200.

In a preferred implementation of the hook assembly 200 where the hook assembly 200 is connected to the spreader bar 202, as shown in FIG. 12, an operator of a kite, such as rider of a kite-board, engages a chicken loop to the hook assembly 200 by pulling a control bar for the kite down and towards the hook assembly 200. The rider then uses a motion, common and well known to those trained in the art of kite-riding, to hook the chicken loop into the region 239 of the hook assembly 200. The retaining bar 208 aids this action by guiding the chicken loop to a region intermediate the end 218 of the hook 201 and the end 212 of the retaining bar 208. As the chicken loop reaches the shackle 225, the shackle 225 bends inwardly into the region 239, out of the way of the chicken loop, such that the chicken loop becomes shackled within the region 239. If the rider pulls the control bar towards the hook assembly 200 again, the shackle 225 guides the chicken loop onto the surface of the legs 210 of the retaining bar 208 facing the region 239. Continued rearward movement of the chicken loop will be arrested when the chicken loop contacts the junction 247 of the retaining bar 208 and the hook 201. Thus, inadvertent disengagement of the chicken loop from the hook assembly 200 is prevented.

Referring to FIG. 12, if, in a starting position, the chicken loop is positioned against the inside curve 243 of the hook 201, the rider can disengage the chicken loop from the hook assembly 200 by merely pulling the control bar back and down. The downward force applied by the rider at the beginning of rearward movement of the chicken loop maintains the chicken loop against the surfaces of the hook 201 near the end 218 facing the region 239. The force causes the shackle 225 to bend outwardly, away from the region 239, such that the chicken loop disengages from the hook assembly 200 instead of being guided onto the surfaces of the legs 210 of the retaining bar 208 facing the region 239. Alternatively, the rider may use one hand to guide the chicken loop out of hook assembly 200.

Advantageously, the inventive hook assembly 200 with the retainer bar 208, when attached to a spreader bar 202, prevents release of a chicken loop contained within the region 239 while the chicken loop is moving rearward, i.e., towards the operator, unless a downward force is added to that movement. The hook assembly 200, thus, will eliminate most inadvertent disengagements of the chicken loop, while simultaneously allowing the rider to quickly and easily disengage the chicken loop from the hook assembly 200, while keeping both hands on the control bar.

In an alternative embodiment, the shackle 225 is omitted from the shackle assembly 200. The chicken loop likely would be retained in the region 239, even in the absence of the shackle 225, based on the high likelihood that rearward movement of the chicken loop would result in the chicken loop sliding onto the surfaces of the legs 210 of the retaining bar 208 facing the region 239.

In another embodiment, the retaining bar 208 is latched or hinged at the point the bar 208 joins the hook 201. By using a latch or hinge mechanism to couple the bar 208 to the hook 201, the retaining bar 208 can be latched in an up position allowing free disengagement of the chicken loop, and in a down position maintaining engagement of the chicken loop, as desired.

In a further embodiment, the retaining bar 208 is omitted from the hook assembly 200, such that only the shackle 92 retains the chicken loop with the region 239.

In still another preferred embodiment, the hook assembly 16 of the attachment or 150 includes a retaining bar 208 extending from the stop 36 into the region 39 and opposing the shackle 92, in the same manner that the retaining bar 208 opposes the shackle 225 in the hook assembly 200.

Although preferred embodiments of the present invention have been described and illustrated, it will be apparent to those skilled in the art that various modifications may be made without departing from the principles of the invention.

What is claimed is:

1. A hook assembly for releasably engaging a coupling element of a tension line comprising:

a hook defining a retaining region for retaining a coupling element of a tension line; and (i) a flexible shackle coupled to the hook and extending partially across an opening of the retaining region, wherein the shackle has a rest position and a bent position, and wherein, in the rest position, the shackle extends substantially across the opening and wherein, when a predetermined force is applied against the shackle, the shackle bends to increase the size of the opening; and (ii) a retaining bar or stop coupled to the hook and extending partially across the opening from the opposite end from the flexible shackle; wherein there is a gap in the opening between the retaining bar or stop and the flexible shackle when the shackle is the rest position.

2. The hook assembly of claim 1, wherein the retaining bar or stop is a retaining bar.

3. The hook assembly of claim 1 further comprising a shackle holder coupled to the hook and sized to receive the flexible shackle, wherein the flexible shackle is releasably secured to the shackle holder.

4. The hook assembly of claim 3 further comprising a plurality of flexible shackles of varying degrees of flexibility.

* * * * *